US007792440B2

(12) United States Patent
Takano et al.

(10) Patent No.: US 7,792,440 B2
(45) **Date of Patent: *Sep. 7, 2010**

(54) IMAGE FORMING APPARATUS AND METHOD THAT CHANGES TONER COMPRESSION ROLLER CONDITION DEPENDING ON TONER DENSITY OR RECORDING MEDIUM TYPE

(75) Inventors: Hidehiro Takano, Matsunoto (JP); Fuminori Yano, Manson Lakes (AU); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 808 days.

This patent is subject to a terminal disclaimer.

(21) Appl. No.: 11/566,079

(22) Filed: Dec. 1, 2006

(65) Prior Publication Data

US 2007/0140737 A1 Jun. 21, 2007

(30) Foreign Application Priority Data

Dec. 2, 2005 (JP) ..... 2005-349284
Dec. 20, 2005 (JP) ..... 2005-366163
Dec. 20, 2005 (JP) ..... 2005-366164

(51) Int. Cl.
*G03G 15/00* (2006.01)

(52) U.S. Cl. ..... 399/45; 399/57; 399/249

(58) Field of Classification Search ..... 399/45, 399/61, 62, 237, 249, 57, 63, 64
See application file for complete search history.

(56) References Cited

U.S. PATENT DOCUMENTS 7,406,274 B2 * 7/2008 Shin et al. ..... 399/57
2004/0131372 A1 * 7/2004 Fujita et al. ..... 399/57

FOREIGN PATENT DOCUMENTS

| | | |
|---|---|---|
| JP | 09-185263 | 7/1997 |
| JP | 11212368 A | 8/1999 |
| JP | 2002091172 A | 3/2002 |
| JP | 2002-189354 | 7/2002 |
| JP | 2002-278291 | 9/2002 |
| JP | 2002-296918 | 10/2002 |
| JP | 2003-091161 | 3/2003 |
| JP | 2005234430 A | 9/2005 |

* cited by examiner

*Primary Examiner*—David M Gray
*Assistant Examiner*—Laura K Roth
(74) *Attorney, Agent, or Firm*—Hogan Lovells US LLP

(57) ABSTRACT

There is provided a development system comprising a developer carrier member that carries a developer, a developer supply roller that supplies the developer carrier member with the developer, a developer container that stores the developer, a toner compression roller that contacts with the developer carrier member and presses toner against the developer carrier member, the toner included in the developer and a density sensing unit that senses a density of the toner in the developer in the developer container. A condition for the toner compression roller is changed depending on the density of the toner in the developer in the developer container or depending on a type of a recording medium.

10 Claims, 13 Drawing Sheets

IMAGE FORMING APPARATUS AND METHOD THAT CHANGES TONER COMPRESSION ROLLER CONDITION DEPENDING ON TONER DENSITY OR RECORDING MEDIUM TYPE

CROSS-REFERENCE TO RELATED APPLICATIONS

This application is based upon and claims the benefit of priority from prior Japanese Patent Application No. 2005-349284 filed Dec. 2, 2005, No. 2005-366163 filed Dec. 20, 2005, and No. 2005-366164 filed Dec. 20, 2005, the entire contents of which are incorporated herein by reference.

BACKGROUND OF THE INVENTION

1. Technical Field

The present invention relates to a liquid development system which develops a latent image formed on an image carrier member with use of a developing agent, an image forming apparatus using a liquid developing agent, by which transfer is carried out at a transfer position of a primary transfer section from an image carrier member to an intermediate transfer member as well as at a transfer position of a secondary transfer section from the intermediate transfer member to a recording medium, and an image forming method thereof.

2. Related Art

Various proposals have been made for a wet image forming apparatus which develops a latent image with use of a highly viscous liquid developing agent, to visualize the electrostatic latent image, whereby the developing agent contains solid toner formed of solid component and dispersed in a liquid solvent. A developing agent used in this wet image forming apparatus is prepared by suspending solid content (toner particles) in an electric insulating organic solvent (carrier liquid) such as a silicon oil, mineral oil, or edible oil. The toner particles are so micronized as to have a particle diameter of 1 μm or so. Due to use of such micro toner particles in a wet image forming apparatus, relatively high quality can be achieved compared with a dry image forming apparatus using toner powder of particles having a particle diameter of about 7 μm.

A carrier liquid contained in a developing agent functions not only to prevent scattering of toner particles having a particle diameter of 1 μm or so but also to make the toner particles charged and further dispersed uniformly. In developing and transfer process, the carrier liquid also functions to allow the toner particles to easily move due to an electric field effect. Thus, a carrier liquid is a necessary component for toner storing process, toner carrying process, developing process, and transfer process. Quantity of this carrier liquid is desirably adjusted depending on the type of a recording medium when performing, at the transfer position of the secondary transfer section, transfer to a recording medium from the intermediate transfer member. That is, the quantity of carrier liquid at the transfer position of the secondary transfer section is desirably adjusted depending on the type of paper, such as paper having a smooth surface which hardly absorbs a carrier liquid or coated paper having a surface coated thick (coated with a large quantity of coating agent), rough paper having coarse texture like recycled paper which easily absorbs the carrier liquid, ordinary paper which absorbs the carrier liquid at an intermediate absorbent rate between the coated paper and rough paper, etc.

Jpn. Pat. Appln. Laid-Open Publication No. 2003-91161 discloses a method for variably adjusting quantity of carrier to be removed depending on paper types, whereby the quantity of carrier to be removed is adjusted by use of a squeeze roller provided on a latent image carrier member. Specific examples of the method for adjusting quantity of carrier to be removed are an adjustment method by changing a nip width between the squeeze roller and the latent image carrier member, another method by changing a difference in bias between the squeeze roller and the latent image carrier member, and yet another method by changing pressure of a cleaning blade above the squeeze roller.

To adjust quantity of carrier to be removed according to a method as described in the Publication No. 2003-91161, a toner image has to be pressed on a latent image (carrier member) with a physical force or a bias has to be applied on a toner image by electricity (an electric field). This causes developed and visualized thin lines to become fat. Alternatively, a turbulence in an image occurs to collapse open areas or an error is caused in transfer to the intermediate transfer member. Further, in the adjustment method by changing pressure of the cleaning blade above the squeeze roller, toner removed and splashed from non-image areas sticks together, so that the splashing toner causes an image disturbance.

SUMMARY OF THE INVENTION

The present invention has been made to address problems as described above and provide a development system for a liquid developer, an image forming apparatus, and an image forming method which, depending on a density of a developer in a developer container or a type of a recording medium, can change a density of the developer at a time point of a development nip between an image carrier member and a developing roller.

According to one aspect of the invention, there is provided a development system including: a developer carrier member that carries a developer; a developer supply roller that supplies the developer carrier member with the developer; a developer container that stores the developer; a toner compression roller that contacts with the developer carrier member and presses toner against the developer carrier member, the toner included in the developer; and a density sensing means for sensing a density of the toner in the developer in the developer container, wherein a condition for the toner compression roller is changed depending on the density of the toner in the developer in the developer container or depending on a type of a recording medium. This development system enables the density of the developer to become closer to an ideal value before reaching the development nip. Accordingly, a uniform image can finally be obtained without unevenness in density.

Preferably, the toner compression roller is provided with a carrier quantity adjustment means for changing a quantity of carrier to be removed. In this development system, compared with a conventional method of adjusting a quantity of carrier through process successive to development process, secondary transfer can be performed under secondary transfer conditions optimized for a paper type without causing disturbance of images.

Still preferably, when the density of the toner in the developer in the developer container is sensed to be lower than a desired value by the density sensing means, a rotation speed of the developer supply roller is increased and the quantity of carrier to be removed by the carrier quantity adjustment means is increased. This development system enables the density of the developer to become closer to an ideal value before reaching the development nip.

Also still preferably, when the density of the toner in the developer in the developer container is sensed to be higher than a desired value by the density sensing means, a rotation speed of the developer supply roller is decreased and the quantity of carrier to be removed by the carrier quantity adjustment means is decreased. This development system also enables the density of the developer to become closer to an ideal value before reaching the development nip.

Also still preferably, the carrier quantity adjustment means is a blade capable of changing a state of contact that the blade makes with the toner compression roller. This development system can be achieved with a simple structure and low costs.

Also still preferably, the carrier quantity adjustment means is a blade capable of changing a state of pressure with which the blade presses the toner compression roller. This development system can also be achieved with a simple structure and low costs.

Also still preferably, the carrier quantity adjustment means is an air knife that injects compressed air to the toner compression roller. This development system can also be achieved with a simple structure and low costs.

Preferably, depending on the type of the recording medium, a rotation speed of the developer supply roller is changed, and a rotation speed and/or bias of the toner compression roller are changed. This development system can also be achieved with a simple structure and low costs.

Also preferably, depending on the type of the recording medium, a contact angle or contact pressure of a regulation blade for regulating a quantity of the developer to be supplied for the developer supply roller is changed, and a rotation speed and/or bias of the toner compression roller are changed. This development system can also be achieved with a simple structure and low costs.

According to another aspect of the invention, there is provided an image forming apparatus including: an image carrier member; a developer carrier member that carries a developer and develops a latent image on the image carrier member; a developer container that stores the developer; a developer supply roller that supplies the developer carrier member with the developer; a toner compression roller that contacts with the developer carrier member and presses toner against the developer carrier member, the toner included in the developer; a primary transfer unit that transfers the developed image formed on the image carrier member to the intermediate transfer member from the image carrier member; and a secondary transfer unit that further transfers the transferred image to a recording medium from the intermediate transfer member, wherein a condition for the toner compression roller is changed depending on a type of a recording medium. This image forming apparatus enables the density of the developer to become closer to an ideal value before reaching the development nip. Accordingly, a uniform image can finally be obtained without unevenness in density. Compared with a conventional method of adjusting a quantity of carrier through process successive to development process, secondary transfer can be performed under secondary transfer conditions optimized for a paper type without causing disturbance of images.

According to still another aspect of the invention, there is provided an image forming method including: supplying a developer from a developer container to a developer carrier member by a developer supply roller, the developer container storing the developer and the developer carrier member carrying the developer; pressing toner included in the developer against the developer carrier member, with a condition changed depending on a type of a recording medium, by a toner compression roller that makes contact with the developer carrier member; developing a latent image formed on an image carrier member, by the developer carrier member, and transferring the developed image from the image carrier member to an intermediate transfer member, at a position of a primary transfer unit; and transferring further the transferred image from the intermediate transfer member to the recording medium, at a transfer position of a secondary transfer unit. This image forming method enables the density of the developer to become closer to an ideal value before reaching the development nip. Accordingly, a uniform image can finally be obtained without unevenness in density. Compared with a conventional method of adjusting a quantity of carrier through process successive to development process, secondary transfer can be performed under secondary transfer conditions optimized for a paper type without causing disturbance of images.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
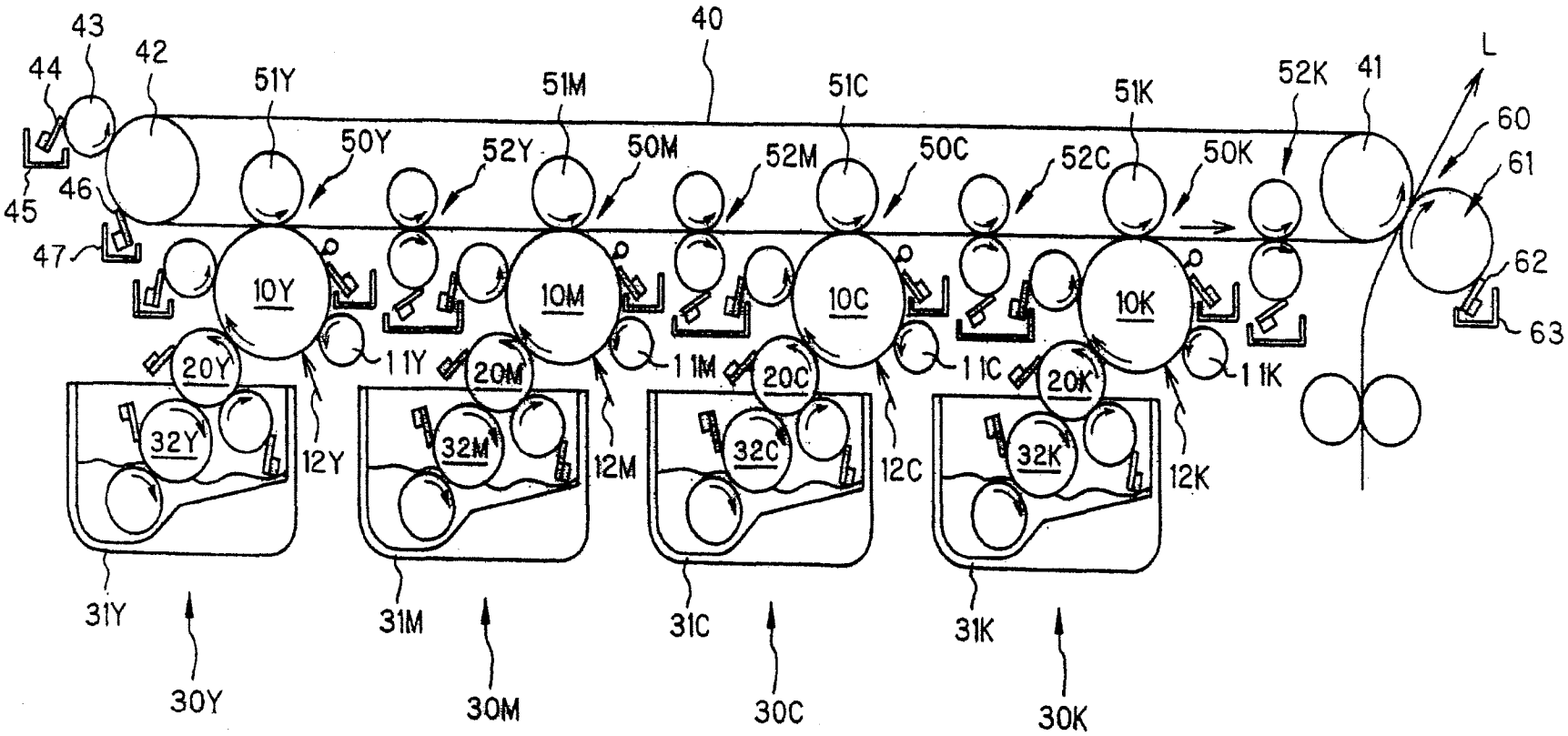
FIG. 1 shows major components constituting an image forming apparatus according to an exemplary embodiment of the invention.

Embodiments of the present invention will now be described with reference to the drawings. FIG. 1 shows main components constituting an image forming apparatus according to an embodiment of the invention. Image forming sections for individual colors are located in the center of the image forming apparatus.

Corresponding to the image forming sections, developing units 30Y, 30M, 30C, and 30K are located at a lower part of the image forming apparatus. An intermediate transfer member 40 and a secondary transfer unit 60 are located at an upper part of the image forming apparatus.

The image forming sections respectively have image carrier members 10Y, 10M, 10C, and 10K, charger rollers 11Y, 11M, 11C, and 11K, exposure units 12Y, 12M, 12C, and 12K (not shown), etc. The exposure units 12Y, 12M, 12C, and 12K each have an optical system including a semiconductor laser, a polygon mirror, a F-? lens, and the like. The image carrier members 10Y, 10M, 10C, and 10K are uniformly charged by the charger rollers 11Y, 11M, 11C, and 11K. Based on an input image signal, the exposure units 12Y, 12M, 12C, and 12K irradiate modulated laser beams to form electrostatic latent images on the charged image carrier members 10Y, 10M, 10C, and 10K.

The developing units 30Y, 30M, 30C, and 30K respectively have, substantially, developing rollers 20Y, 20M, 20C, and 20K, developer containers (reservoirs) 31Y, 31M, 31C, and 31K containing liquid developers for respective colors of yellow (Y), magenta (M), cyan (C), and black (K), developer supply rollers 32Y, 32M, 32C, and 32K, etc. The developer supply rollers respectively supply the developing rollers 20Y, 20M, 20C, and 20K with the liquid developers of respective colors from the developer containers 31Y, 31M, 31C, and 31K. The developing units respectively develop electrostatic latent images formed on the image carrier members 10Y, 10M, 10C, and 10K, using the liquid developers for the respective colors.

The intermediate transfer member 40 is an endless belt tensioned between a drive roller 41 and a tension roller 42. The intermediate transfer member 40 is driven by the drive roller 41 so as to rotate kept in contact with the image carrier members 10Y, 10M, 11C, and 10K in primary transfer units 50Y, 50M, 50C, and 50K. In the primary transfer units 50Y, 50M, 50C, and 50K, primary transfer rollers 51Y, 51M, 51C, and 51K are opposed to the image carrier members 10Y, 10M, 10C, and 10K with the intermediate transfer member 40 inserted therebetween. At transfer positions which are contact positions with the image carrier members 10Y, 10M, 10C, and 10K, developed toner images for respective colors on the image carrier members 10Y, 10M, 10C, and 10K are sequentially transferred to the intermediate transfer member 40 with the toner images overlapped on one another and a full-color toner image is formed.

In the secondary transfer unit 60, a secondary transfer roller 61 is opposed to the belt drive roller 41 with the intermediate transfer member 40 inserts therebetween. A cleaning device, which includes a secondary transfer roller cleaning blade 62 and a developer collection part 63, is provided also in the secondary transfer unit 60. At a transfer position where the secondary transfer roller 61 is located, the secondary transfer unit 60 transfers a single color toner image or full-color toner image formed on the intermediate transfer member 40 to a recording medium such as a paper sheet, film, or cloth being conveyed along a sheet material convey path L.

In the front side along the sheet material convey path L, a fixture unit (not shown) is provided to fuse and fix, to a recording medium such as a paper sheet, the mono color toner image or full-color toner image which has already been transferred to the recording medium.

The tension roller 42 cooperates with the belt drive roller 41 to tension the intermediate transfer member 40. At a portion where the intermediate transfer member 40 is wound around the tension roller 42, a cleaning device, which includes an intermediate transfer member cleaning blade 46 and a developer collect section 47, is provided in contact with the intermediate transfer member 40.

Figure 2:
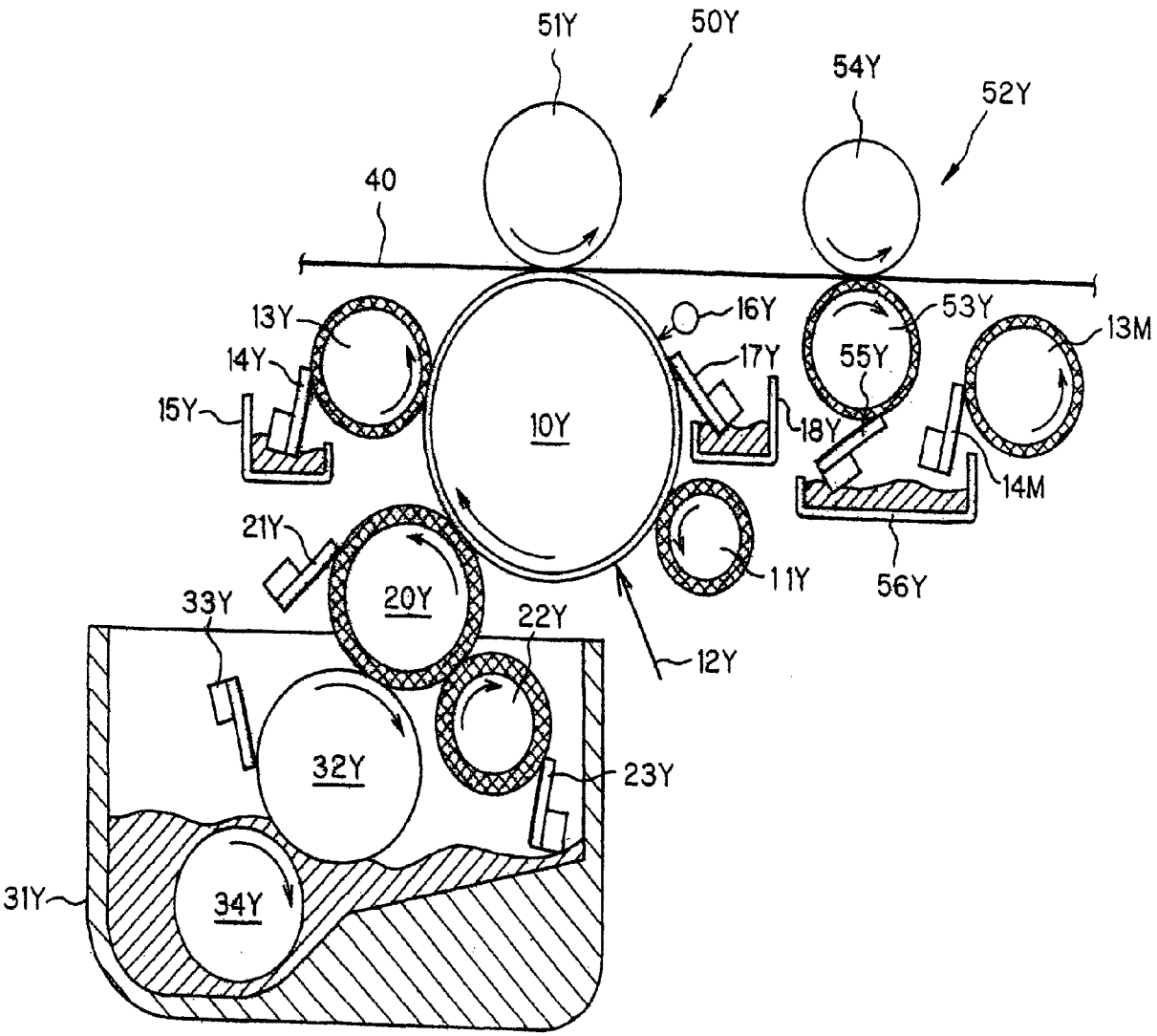
FIG. 2 is a cross-sectional view showing main components of an image forming section and a developing unit.
Figure 3:
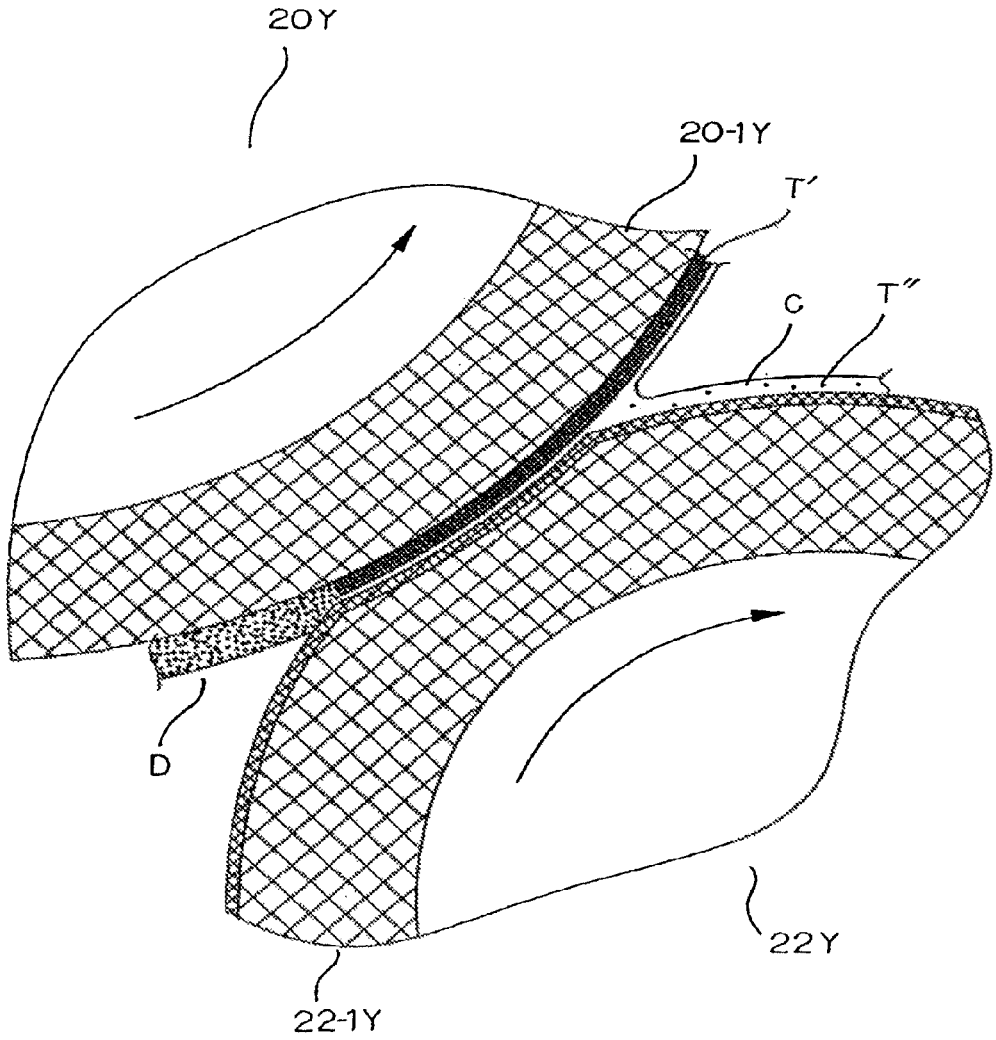
FIG. 3 shows compaction of a developer using a toner compression roller 22Y.
Figure 4:
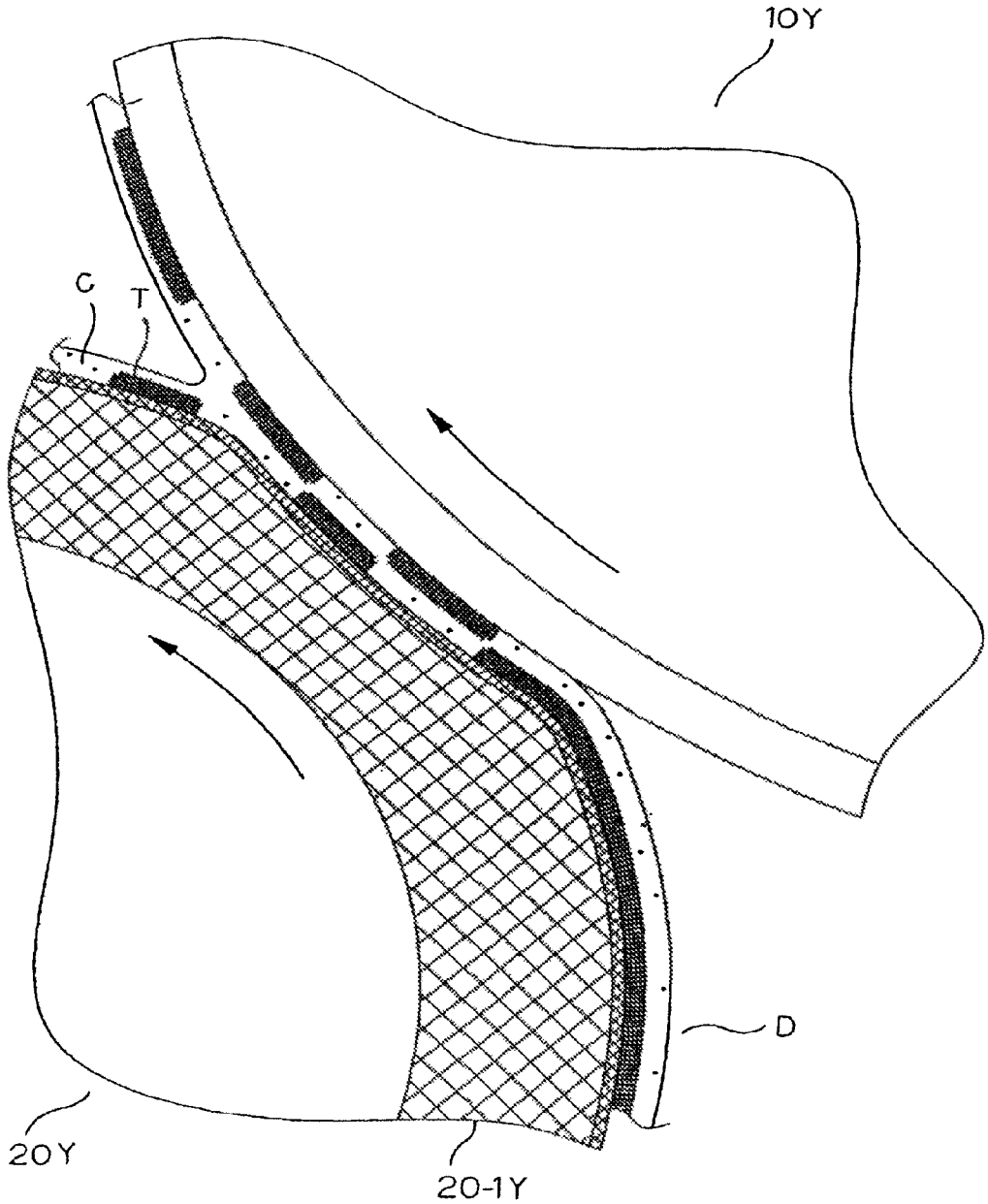
FIG. 4 depicts development using a developing roller 20Y.
Figure 5:
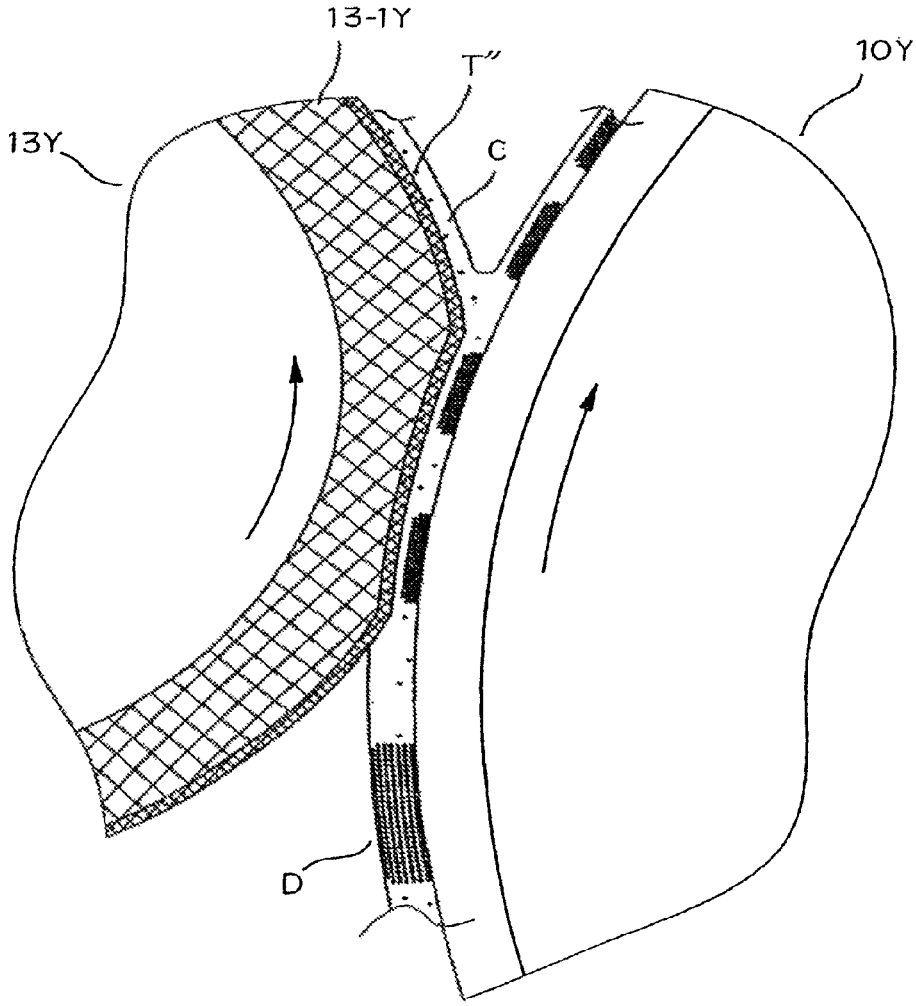
FIG. 5 depicts a squeeze effect caused by an image carrier member squeeze roller 13Y.
Figure 6:
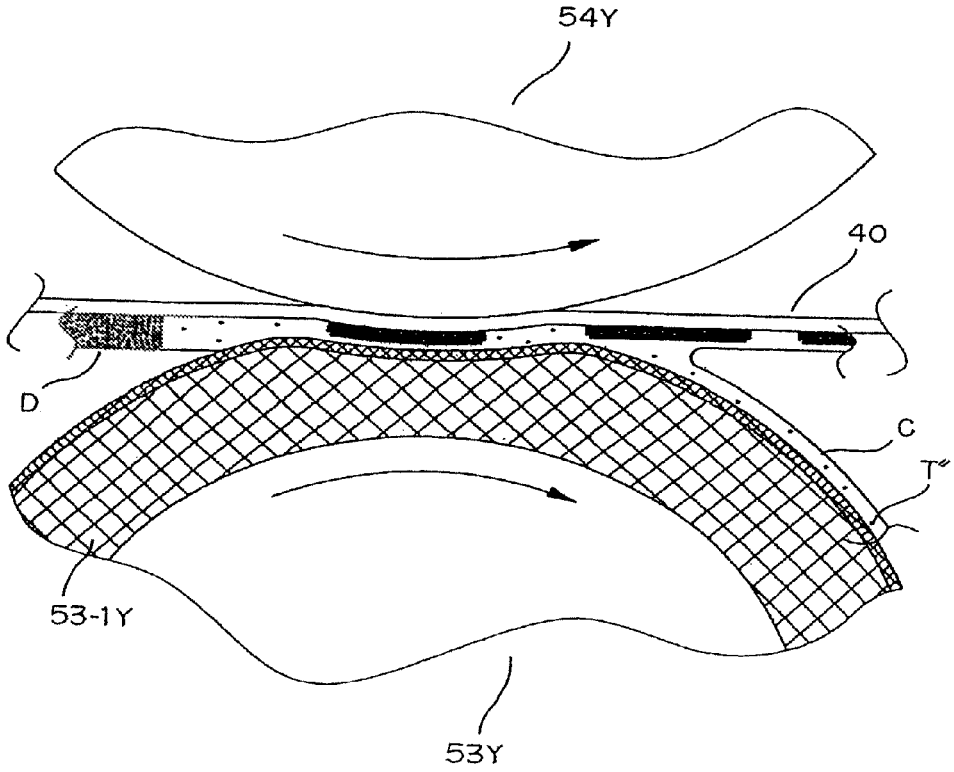
FIG. 6 depicts a squeeze effect caused by an intermediate transfer member squeeze device 52Y.

Next, the image forming sections and the developing units will be described. FIG. 2 is a cross-sectional view showing main components of an image forming section and a developing unit. FIG. 3 shows a compaction using a toner compression roller 22Y. FIG. 4 depicts development using a developing roller 20Y. FIG. 5 depicts a squeeze effect caused by an image carrier member squeeze roller 13Y. FIG. 6 depicts a squeeze effect caused by an intermediate transfer member squeeze device 52Y. The image forming section and developing unit for each color has one common structure, and therefore, the following description will be made based on the image forming section and developing unit for yellow (Y).

Along an outer circumferential rotation direction of the image carrier member 10Y in the image forming section, there are provided: a cleaning device including a latent image eraser 16Y, an image carrier member cleaning blade 17Y, and a developer collect section 18Y; a charger roller 11Y; an exposure unit 12Y; a developing roller 20Y of the developing unit 30Y; a cleaning device including an image carrier member squeeze roller 13Y, an image carrier member squeeze roller cleaning blade 14Y as a supplementary structure for the roller 13Y, and a developer collect section 15Y. Further, along an outer circumferential rotation direction of the developing roller 20Y, there are provided a cleaning blade 21Y, a developer supply roller 32Y using an ANILOX roller, and a toner compression roller 22Y. A carrier quantity adjustment blade 23Y is provided on the circumference of the toner compression roller 22Y. Further, a liquid developer stir roller 34Y and the developer supply roller 32Y are contained in the liquid developer container 31Y. Along the intermediate transfer member 40, a primary transfer roller 51Y for a primary transfer unit is provided so as to oppose the image carrier member 10Y. An intermediate transfer member squeeze device 52Y including an intermediate transfer member squeeze roller 53Y, a backup roller 54Y, an intermediate transfer member squeeze roller cleaning blade 55Y, and a developer collect section 56Y is provided in the downstream side along a moving direction of the primary transfer roller 51Y.

The image carrier member 10Y is a photosensitive drum which is wider than the developing roller 20Y having a width of about 320 mm. The photosensitive drum is constituted by a cylindrical member having an outer circumferential surface on which a photosensitive layer is formed. The image carrier member 10Y rotates, for example, in a clockwise direction as shown in FIG. 2. The photosensitive layer of the image carrier member 10Y is formed as an organic carrier material, an amorphous silicon image carrier member, or the like. The charger roller 11Y is provided in the upstream side along the rotation direction of the image carrier member 10Y, relative to a nip part between the image carrier member 10Y and the developing roller 20Y. The charger roller 11Y is applied with a bias of the same polarity as the toner charging polarity from a power supply device (not shown), and charges electrically the image carrier member 10Y. In the downstream side along the rotation direction of the image carrier member 10Y, the exposure unit 12Y irradiates a laser beam onto the image carrier member 10Y electrically charged by the charger roller 11Y, thereby forming a latent image on the image carrier member 10Y.

The developing unit 30Y includes: the toner compression roller 22Y; the developer container 31Y which reserves a liquid developer containing toner dispersed at about 20% in a carrier; the developing roller 20 which carries the liquid developer; the developer supply roller 32Y, a regulation blade 33Y, and a stir roller 34Y, which stir the liquid developer to maintain the liquid developer uniformly dispersed and supply the liquid developer to the developing roller 20Y; the toner compression roller 22Y which brings into a compaction state the liquid developer carried by the developing roller 20Y; and the roller cleaning blade 21Y which cleans the developing roller 20Y.

The liquid developer contained in the developer container 31Y is not a commonly used volatile liquid developer of a low density (approximately 1 to 2 wt %) and a low viscosity using Isopar (commercial name: EXXON) as a carrier but is a non-volatile liquid developer which is not volatile at normal temperature. That is, the liquid developer used in the present invention is a highly viscous liquid developer (having a viscosity of about 30 to 10,000 mPa*s) obtained by adding solid particles and a dispersion agent together to a liquid solvent such as an organic solvent, silicon oil, mineral oil, or edible oil, setting a toner solid density to approximately 20%. The solid particles have an average particle diameter of 1 μm and are prepared by dispersing a coloring agent such as a pigment in a thermoplastic resin.

The developer supply roller 32Y is a cylindrical member, such as an ANILOX roller that rotates in a clockwise direction as shown in FIG. 2 and has a surface where a corrugated face is formed finely and uniformly by a spiral groove so that the liquid developer can be easily carried. The size of the groove has a groove pitch of about 130 μm and a depth of about 30 μm. This developer supply roller 32Y supplies the liquid developer from the developer container 31Y to the developing roller 20Y. The stir roller 34Y and the developer supply roller 32Y can be positioned so as to slidably contact with each other or away from each other.

The regulator blade 33Y is constituted by an elastic blade having a surface covered with an elastic material, a rubber part made of urethane rubber or the like which makes contact with the surface of the developer supply roller 32Y, and a plate made of metal or the like and supporting the rubber part. The regulator blade 33Y regulates and adjusts thickness and quantity of a film consisting of the liquid developer carried by the developer supply roller 32Y as an ANILOX roller, to control quantity of the liquid developer supplied to the developing roller 20Y. As an alternative, the rotation direction of the developer supply roller 32Y can be opposite to the arrow direction shown in FIG. 2. In this case, the regulator blade 33Y should accordingly be positioned so as to suit the rotation direction.

The developing roller 20Y is a cylindrical member which is approximately 320 mm wide, and rotates in the anti-clockwise direction as shown in FIG. 2 about a rotation axle. The developing roller 20Y is prepared by providing an elastic layer made of polyurethane rubber, silicon rubber, NBR, or the like on an outer circumferential part of an inner core made of metal such as iron. The developing roller cleaning blade 21Y is made of rubber that makes contact with the surface of the developing roller 20Y, and is located in the downstream side along the rotation direction of the developing roller 20Y, relative to a nip part where the developing roller 20Y is in contact with the image carrier member 10Y. The developing roller cleaning blade 21Y scrapes off and removes the liquid developer remaining on the developing roller 20Y.

The toner compression roller 22Y is a cylindrical member and formed as an elastic roller by covering the surface of this roller 22Y with an elastic material 22-1Y as shown in FIG. 3, like in the developing roller 20Y. The toner compression roller 22Y has a structure provided with a conductive resin layer or rubber layer is on an surface layer of a metal roller base material, and rotates in the clockwise direction opposite to the rotation direction of the developing roller 20Y, for example, as shown in FIG. 2. The toner compression roller 22Y has a means for increasing a charge bias to the surface of the developing roller 20Y. The developer carried by the developing roller 20Y is applied with an electric field from the side of the toner compression roller 22Y toward the developing roller 20Y, at a compaction portion where a nip is formed by the toner compression roller 22Y in slidable contact with the developing roller 20Y, as shown in FIGS. 2 and 3. This electric field application means for compaction can be substituted for by a corona charger which performs corona charging, in place of the roller shown in FIG. 2.

This toner compression roller 22Y moves and condenses toner T dispersed uniformly in a carrier C to the side of the developing roller 20Y, to prepare a so-called compaction state T'. Further, the toner compression roller 22Y rotates in the arrow direction shown in the figure, carrying a portion of the carrier C and a slight quantity of toner T" not subjected to the compaction. The portion of carrier C and the slight quantity of toner are scraped off and removed by the carrier quantity adjustment blade 23Y, and are then mixed into the developer in the reservoir 31Y for recycle use. This carrier quantity adjustment blade 23Y will be described in the later half of this specification. In the meantime, a portion of the developer D carried by the developing roller 20Y and subjected to the compaction is developed by a desired electric field applied according to a latent image on the image carrier member 10Y, at a nip part where the developing roller 20Y is in contact with the image carrier member 10Y as shown in FIG. 4. Further, a remaining portion of the developer D subjected to development is scraped off and removed by the developing roller cleaning blade 21Y and mixed up with the developer in the reservoir 31Y for recycle use. Although the carrier and toner are thus mixed, mixture of toner or carriers of different colors is not involved in this case.

The image carrier member squeeze device is provided in the downstream side of the developing device 20Y, opposed to the image carrier member 10Y, and collects an excessive portion of the developer from the toner image developed on the image carrier member 10Y. As shown in FIGS. 2 and 5, the image carrier member squeeze device includes: the image carrier member squeeze roller 13Y constituted by an elastic roller member which has a surface covered with an elastic material 13-1Y and rotates in slidable contact with the image carrier member 10Y; and a cleaning blade 14Y which is pressed into contact with the image carrier member squeeze roller 13Y and cleans the surface of the roller 13Y. As shown in FIG. 5, the image carrier member squeeze device functions to collect an excessive portion of the carrier C and splashing toner T", which is unnecessary, from the developer D developed on the image carrier member 10Y, so as to raise a content ratio of toner particles in a latent image. Capability of collecting an excessive portion of carrier C can be set to desired capability, depending on the rotation direction of the image carrier member squeeze roller 13Y and on a relative difference from a circumferential speed of the surface of the image carrier member squeeze roller 13Y to that of the image carrier member 10Y. The collection capability is enhanced as the image carrier member squeeze roller 13Y is rotated in a counter direction to the rotation direction of the image carrier member 10Y. Also, the collection capability is enhanced as the difference between both circumferential speeds is raised. Furthermore, synergistic interaction between the rotation direction and the speed is available.

In this embodiment, the image carrier member squeeze roller 13Y is (with-)rotated substantially at the same circumferential speed as the image carrier member 10Y, as an example shown in FIG. 5, to collect an excessive portion of the carrier C of about 5 to 10 weight % from the developer D subjected to development on the image carrier member 10Y. Accordingly, load generated by rotation of both of these rollers is reduced, and disturbance on a visualized toner image on the image carrier member 10Y is restricted. The excessive portion of the carrier C and unnecessary splashing toner T" removed by the image carrier member squeeze roller 13Y are collected and pooled into the developer collect section 15Y from the image carrier member squeeze roller 13Y by operation of the cleaning blade 14Y. The excessive portion of the carrier C and the splashing toner T" are collected from the image carrier member 10Y which is isolated and dedicated to one color, mixture of colors do not occur from any part.

In the primary transfer unit 50Y, the developer image developed on the image carrier member 10Y is transferred to the intermediate transfer member 40 by the primary transfer roller 51Y. In this process, the image carrier member 10Y and the intermediate transfer member 40 are configured to move at an equal speed, so that load caused by rotation and motion thereof is reduced and disturbance on the visualized toner image on the image carrier member 10Y is suppressed. Since primary transfer carried out by the primary transfer unit 50Y is the first transfer for the first color, no mixing of color occurs. However, for each of the second and later colors, a different toner image is transferred on one or more toner images which have already been subjected to primary transfer. As a result, colors are overlaid, thereby causing a so-called reverse transfer phenomenon in which toner is reversely transferred from the intermediate transfer member 40 to the image carrier member 10 (M, C, or K). The reversely transferred toner and the remaining toner after transfer are mixed and carried together with an excessive portion of carrier by the image carrier member 10 (M, C, or K), with the colors mixed. The toner thus mixed up is thus moved and then collected and pooled by operation of the cleaning blade (M, C, or K) from the image carrier member.

The intermediate transfer member squeeze device 52Y is located in the downstream side of the primary transfer section 50Y. This squeeze device 52Y removes an excessive portion of carrier liquid from above the intermediate transfer member 40 and raises the toner particle content ratio inside the visualized image. In a stage in which the quantity of carrier in the developer (dispersed in the carrier) transferred to the intermediate transfer member 40 by the primary transfer unit 50Y is subjected to secondary transfer to a sheet material in a final stage as described previously to advance to a fixture process omitted from the figures, there is a case that a desirable dispersion state of the liquid developer for exerting a preferable secondary transfer function and a fixture function is not yet reached, e.g., a substantial toner weight ratio of 40% to 60% is not yet reached. The intermediate transfer member squeeze device 52Y is provided as a means for further removing, in this case, an excessive portion of the carrier from the intermediate transfer member 40. Like the image carrier member squeeze device, the intermediate transfer member squeeze device 52Y includes: an intermediate transfer member squeeze roller 53Y constituted by an elastic roller member which has a surface covered with an elastic material and rotates in slidable contact with the intermediate transfer member 40; a backup roller 54Y opposed to the squeeze roller 53Y with the intermediate transfer member 40 inserted therebetween; a cleaning blade 55Y which is pressed into slidable contact with the intermediate transfer member squeeze roller 53Y to clean the surface of the roller 53Y; and a developer collect section 56Y. The intermediate transfer member squeeze device 52Y has a function of collecting an excessive portion of carrier C and unnecessary splashing toner T" from the developer D transferred by primary transfer to the intermediate transfer member 40 as shown in FIG. 6. The developer collect section 56Y also functions as a structure for collecting a carrier liquid collected by an image carrier member squeeze roller cleaning blade 14M for magenta which is located in the downstream side of the section 56Y.

Capability of collecting an excessive portion of the carrier can be set to desired capability, depending on the rotation direction of the intermediate transfer member squeeze roller 53Y and on a relative difference from a circumferential speed of the surface of the intermediate transfer member squeeze roller 53Y to the moving speed of the intermediate transfer member 40. The collection capability is enhanced as the intermediate transfer member squeeze roller 53Y is rotated in a counter direction to the moving direction of the intermediate transfer member 40. Also, the collection capability is enhanced as the difference between the circumferential speeds is increased. Furthermore, synergistic interaction between the rotation direction and the speed is available. In this embodiment, the intermediate transfer member squeeze roller 53Y is (with-)rotated substantially at the same circumferential speed as the intermediate transfer member 40, as an example, to collect an excessive portion of the carrier C of about 5 to 10 weight % from the developer transferred by primary transfer to the intermediate transfer member 40, and also to collect splashing toner. Accordingly, load generated by rotation of both of the roller and the intermediate transfer member is reduced, and disturbance on a toner image on the intermediate transfer member 40 is suppressed.

At an intermediate transfer member squeeze portion for the first color, first squeezing is carried out for the intermediate transfer member, mixing of colors does not take place. However, for each of the second and later colors, a different toner image is transferred to an area of on one or more toner images which have already been subjected to primary transfer. As a result, toner transferred from the intermediate transfer member 40 to the intermediate transfer member squeeze roller 53Y is subjected to mixing of colors and moves together with an excessive portion of the carrier, carried by the intermediate transfer member squeeze roller 53Y. The toner mixed is thus moved and then collected and pooled by operation of a cleaning blade from the intermediate transfer member squeeze roller 53Y. If squeeze capability of the intermediate transfer member 40 in the upstream side of the flow of the intermediate transfer member squeeze process and squeeze capability of the intermediate transfer member squeeze roller 53Y are exerted satisfactorily, an intermediate transfer member squeeze device need not always be provided in the downstream side of every primary transfer process.

Next, operation of the image forming apparatus according to the present invention will be described. With respect to the image forming sections and developing units, only the image forming section and developing unit 30Y for yellow will be described as a common example, following the manner of description made above.

In the developer container 31Y, toner particles in the liquid developer which have positive charges are stirred by the stir roller 34Y. As the developer supply roller 32Y rotates, the liquid developer is taken up from the developer container 31Y. In a liquid development type image forming apparatus according to this embodiment which uses a developer in which toner is dispersed in a carrier, a developer in which toner of a substantial weight ratio of 20% is dispersed in a carrier of a substantial weight ratio of 80% is used. Through various processes, control is carried out aiming at, as a toner weight ratio (a solid content rate) at a position immediately before secondary transfer to a sheet material, i.e., a so-called secondary transfer position, 45% or so in case of smooth paper such as coated paper, 55% or so in case of ordinary paper, and 60% or so in case of rough paper such as recycled paper having coarse texture. Initially, the developer stored in the developer container 31Y is dispersed at a substantial toner weight ratio of about 20% in a carrier. However, in case of development of a high image duty, a toner consumption ratio is high. Inversely, in case of development of a low image duty, the toner consumption ratio is low. That is, the toner weight ratio of the developer stored in the developer container 31Y changes moment by moment as development on the image carrier member 10Y progresses. This change needs to be always monitored and controlled to a state in which the substantial toner weight ratio is about 20%.

Hence, in this embodiment, a monitor means omitted from the figures is provided in the developer container 31Y. The monitor means is, for example, a photosensor of a transmission type which detects a weight ratio of dispersed toner, or a torque detection means for detecting stirring torque with which the developer is stirred and a photosensor of a reflection type which detects the surface of the liquid developer in the developer container 31Y. Owing to this monitor means, a predetermined quantity of developer containing toner dispersed at a high density of about 35 to 55% is charged from a developer cartridge when the weight ratio of dispersed toner decreases to be low. Inversely, a predetermined quantity of carrier is charged from the carrier cartridge, when the weight ratio of dispersed toner increases to be high. The substantial toner weight ratio is thus controlled to about 20%, and the developer is stirred inside the developer container 31Y so that toner is dispersed uniformly.

The regulation blade 33Y makes contact with the surface of the developer supply roller 32Y, and scrapes off an excessive portion of the liquid developer other than a remaining portion of the liquid developer remaining in the groove in the convex concave ANILOX pattern formed in the surface of the developer supply roller 32Y. Thus, the quantity of liquid developer supplied to the developing roller 20Y is regulated. By this regulation, the film thickness of the liquid developer applied to the developing roller 20Y is regulated to approximately 6 μm. The portion of the liquid developer scraped off by the regulation blade 33Y drops back into the developer container 31Y due to gravity. The other portion of the liquid developer not scraped off is accumulated in the groove of the convex concave face of the developer supply roller 32Y and is then pressed to and thereby applied to the developing roller 20Y.

The developing roller 20Y applied with the liquid developer by the developer supply roller 32Y is contact with the toner compression roller 22Y in the downstream side of a nip with the developer supply roller 32Y. The developing roller 20Y is biased to approximately +400 V. The toner compression roller 22Y is applied with a bias of the same polarity as the polarity of charged toner. For example, the toner compression roller 22Y is biased to approximately +600 V. Therefore, toner particles in the liquid developer on the developing roller 20Y are moved to the side of the developing roller 20Y when the toner particles pass through the nip with the toner compression roller 22Y, as shown in FIG. 3. In this manner, the toner particles are bound to one another, forming a film. When development is carried out by the image carrier member 10Y, the toner particles move swiftly from the developing roller 20Y to the image carrier member 10Y, so that the image density improves.

The image carrier member 10Y is made of amorphous silicon. After the surface of the image carrier member 10Y is charged to approximately +600 V by the charger roller 11Y in the upstream side of a nip with the developing roller 20Y, a latent image is formed by the exposure unit 12Y so that an image part corresponding to the latent image has an electric potential of +25 V. At a development nip formed between the developing roller 20Y and the image carrier member 10Y, toner particles T selectively move to the image part on the image carrier member 10Y as shown in FIG. 4, in accordance with an electric field generated by the bias of +400 V applied to the developing roller 20Y and the latent image on the image carrier member 10Y (image part: +25 V, non-image part: +600V). As a result of this, a toner image is formed on the image carrier member 10Y. Since the carrier liquid C is not influenced from the electric field, the carrier liquid C is divided, at an end of the development nip between the developing roller 20Y and the image carrier member 10Y, into portions which respectively stick to both the developing roller 20Y and the image carrier member 10Y. The image carrier member 10Y which has passed through the development nip further passes through the image carrier member squeeze roller 13Y. As shown in FIG. 5, process of removing an excessive portion of the carrier liquid C is carried out to raise the ratio of toner particles contained in the visualized image.

Next, the image carrier member 10Y passes through a nip with the intermediate transfer member 40 at the primary transfer unit SOY, to perform primary transfer of the visualized image to the intermediate transfer member 40. The primary transfer roller 51Y is applied with approximately −200 V of a polarity opposite to the polarity of the charged toner particles, and toner is thereby subjected to primary transfer to the intermediate transfer member 40 from the image carrier member 10Y. Only the carrier liquid remains on the image carrier member 10Y. In the downstream side relative to the primary transfer unit along the rotation direction of the image carrier member 10Y, the electrostatic latent image is erased from the image carrier member 10Y after the primary transfer, by the latent image eraser 16Y constituted by a lamp or the like. The carrier liquid remaining on the image carrier member 10Y is scraped off by the image carrier member cleaning blade 17Y, and collected by the developer container 18Y.

The toner image transferred by primary transfer to the intermediate transfer member 40 by the primary transfer unit 50Y passes through the intermediate transfer member squeeze device 52Y to scrape off an excessive portion of carrier from the intermediate transfer member 40. The intermediate transfer member squeeze roller 53Y of the intermediate transfer member squeeze device 52Y is applied with +400 V, as well as the intermediate transfer member squeeze backup roller 54Y with +200 V, thereby generating an electric field so as to press toner particles against the intermediate transfer member 40. Therefore, as shown in FIG. 6, toner particles are not collected by the intermediate transfer member squeeze roller 53Y. Only the carrier liquid not influenced by the electric field is collected as the intermediate transfer member 40 and the intermediate transfer member squeeze roller 53Y separate from each other.

The toner image on the intermediate transfer member 40 goes then to the secondary transfer unit 60, and enters into a nip between the intermediate transfer member 40 and the secondary transfer roller 61. In this case, the nip width is set to 3 mm. In the secondary transfer unit 60, the secondary transfer roller 61 is applied with −1200 V, as well as the belt drive roller 41 with +200 V. These voltages transfer the toner image from the intermediate transfer member 40 to a recording medium such as a paper sheet.

After passing through the secondary transfer unit 60, the intermediate transfer member 40 goes to a winding part of the tension roller 42. Cleaning of the intermediate transfer member 40 is carried out by the intermediate transfer member cleaning blade 46, and the intermediate transfer member 40 goes again to the primary transfer units 50.

Next, the squeeze function of the secondary transfer roller 61 will be described. At timing at which toner images of colors overlaid on the intermediate transfer member 40 reach a secondary transfer portion, a sheet material is supplied for secondary transfer of the toner images to the sheet material. Operation further advances to fixture process omitted from the figures, and image formation onto the sheet material is finished finally. However, if a trouble such as jamming occurs concerning supply of the sheet material, toner images make direct contact with the secondary transfer roller 61 with no sheet material interposed therebetween, which causes staining of the back face of the sheet material. As a means for improving the secondary transfer characteristic even with respect to a rough sheet material having a fibered surface, the secondary transfer roller 61 according to this embodiment is constituted by an elastic roller having a surface covered with an elastic material for the same purpose as that of the elastic belt used for the intermediate transfer member 40 which carries toner images formed on plural photosensitive members, sequentially subjected to primary transfer, and overlaid on one another, and transfers the toner images to the sheet material by the secondary transfer. The secondary transfer roller cleaning blade 62 is provided as a means for removing a portion of developer (i.e., toner dispersed in a carrier) transferred to the secondary transfer roller 61, and collects and pools the portion of developer from the secondary transfer roller 61. The pooled portion of developer includes developers of different colors mixed, and occasionally includes even foreign materials.

Next, the cleaning device for the intermediate transfer member 40 will be described. If a trouble such as jamming occurs concerning supply of the sheet material, all the toner images are not transferred to the secondary transfer roller 61 and then collected. That is, toner partially remains on the intermediate transfer member 40. Even in ordinary secondary transfer process, 100% of toner images on the intermediate transfer member 40 are not subjected to secondary transfer to the sheet material. Several percents of toner remains after the secondary transfer. These two kinds of unnecessary toner images are collected and pooled for next image formation by the intermediate transfer member cleaning blade 46 and the developer collect section 47 which are provided in the downstream side along the moving direction of the intermediate transfer member 40.

Each of the embodiments will now be described below.

In the first embodiment, when a monitor means detects that a density of a developer in the developer container 31Y has changed from a predetermined density, control is performed so as to maintain the density to be as uniform as possible at a development nip created between the image carrier member 10Y and the developing roller 20Y.

More specifically, when the monitor means detects that the density of developer in the developer container 31Y has decreased lower than the predetermined density, control is then performed so as to increase the quantity of carrier to be removed by the carrier quantity adjustment blade 23Y in contact with the toner compression roller 22Y, and so as to increase the rotation speed of the developer supply roller 32Y. Inversely, when the monitor means detects that the density of developer in the developer container 31Y has increased higher than the predetermined density, control is then performed so as to decrease the quantity of carrier to be removed by the carrier quantity adjustment blade 23Y in contact with the toner compression roller 22Y, and so as to decrease the rotation speed of the developer supply roller 32Y. Details of such control will now be described below.

Figure 7:
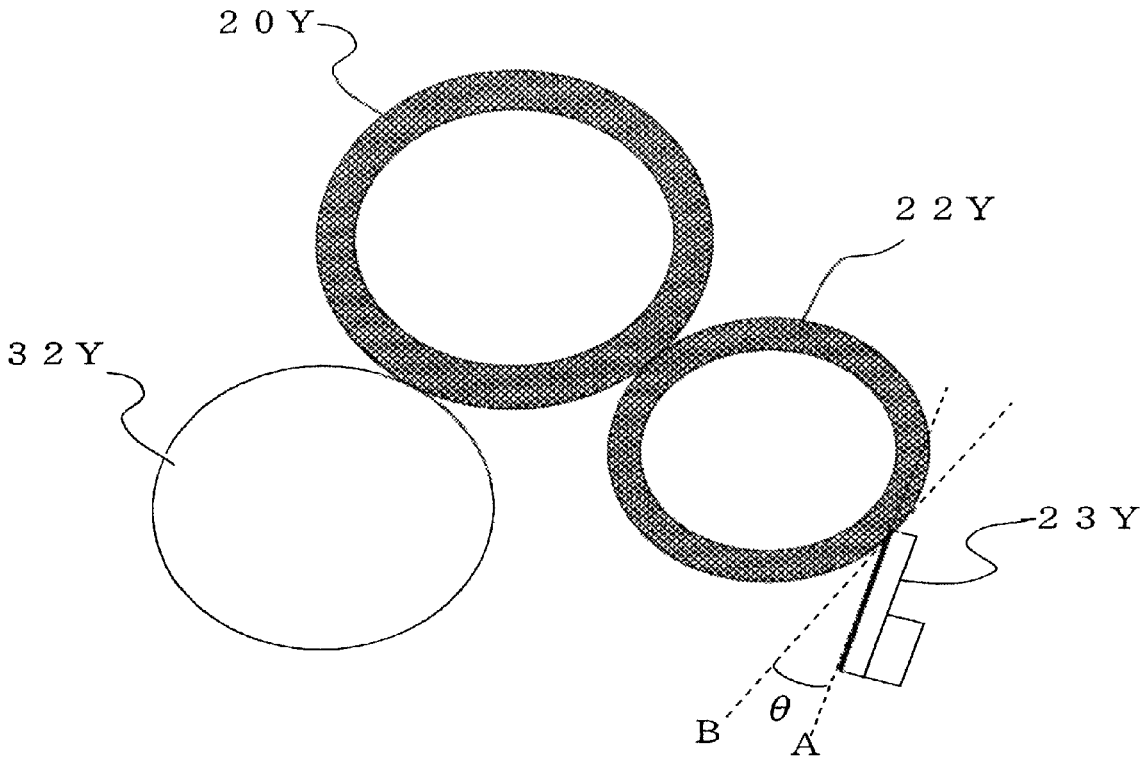
FIG. 7 shows a contact state of a carrier quantity adjustment blade 23Y in contact with the toner compression roller 22Y, and also shows the developing roller 20Y, and a developer supply roller 32Y.

FIG. 7 shows a contact state of the carrier quantity adjustment blade 23Y in contact with the toner compression roller 22Y, and also shows the developing roller 20Y, and the developer supply roller 32Y.

In FIG. 7, ? denotes an angle defined as a contact angle of the carrier quantity adjustment blade 23Y, i.e., an angle between an extension (A) of a not-curved part of the carrier quantity adjustment blade 23Y (non-contact part) and a tangent (B) which extends through a contact point between the carrier quantity adjustment blade 23Y and the toner compression roller 22Y. In Example 1 of this embodiment, a contact angle change mechanism for the carrier quantity adjustment blade 23Y is provided to change the contact angle ?. This contact angle change mechanism is configured to be capable of changing a contact state between the toner compression roller 22Y and the carrier quantity adjustment blade 23Y at the same time when changing the contact angle. More specifically, the carrier quantity adjustment blade 23Y can change conditions of a contact state, such as a contact point at which the carrier quantity adjustment blade 23Y makes contact with the toner compression roller 22Y, and a biting amount by which the carrier quantity adjustment blade 23Y bites into the roller 22Y.

Table 1 shows developer supply roller linear speeds, carrier quantity adjustment blade angles, carrier quantity adjustment blade biting amounts, and development nip densities where the contact state in which the carrier quantity adjustment blade 23Y makes contact with the toner compression roller 22Y is changed by the contact angle change mechanism, in correspondence with densities inside a developer container which are detected by a monitor means, and the rotation speed of the developer supply roller 32Y is changed.

TABLE 1

| State | Density inside the developer container [wt %] | Developer supply roller linear speed [mm/s] | Carrier amount adjustment blade angle [°] | carrier quantity adjustment blade biting amount [mm] | Density at the development nip [wt %] |
|---|---|---|---|---|---|
| Low density | 17 | 232 | 10 | 0.15 | 23.2 |
| Standard | 20 | 208 | 0 | 0.1 | 23.3 |
| High density | 23 | 183 | 0 | 0 | 23.4 |

If "Standard" applies to the column of "State" in Table 1, i.e., if the developer density inside the developer container 31Y is detected to be 20 wt % by the monitor means, an ideal developer density state is attained. At this time, control for normal image formation is carried out. That is, the developer supply roller linear speed is set to 208 mm/s, and the contact angle of the carrier quantity adjustment blade 23Y is set to 0° by the contact angle change mechanism. At this time, the carrier quantity adjustment blade 23Y is adjusted to bite into the toner compression roller 22Y by a biting amount of 0.1 mm. When such an ideal state is achieved concerning the density of the developer in the developer container 31Y, the density of the developer at the development nip is 23.3 wt %.

Described next will be a case that the monitor means detects that the density of the developer in the developer container 31Y has decreased lower than a predetermined density. This case corresponds to the state of "Low density" in Table 1. In this case, for example, when the monitor means detects that the density of the developer in the developer container 31Y is 17 wt %, control is carried out so as to increase the quantity of carrier removed by the carrier quantity adjustment blade 23Y in contact with the toner compression roller 22Y and so as to increase the rotation speed of the developer supply roller 32Y. Such control is performed to suppress changes in density of the developer at the development nip. More specifically, the developer supply roller linear speed is increased to 232 mm/s, and the contact angle of the carrier quantity adjustment blade 23Y is set to 10° by the contact angle change mechanism. At this time, the carrier quantity adjustment blade 23Y is adjusted to bite into the toner compression roller 22Y by a biting amount of 0.15 mm, so that greater quantity of carrier is removed. By such control, the density of the developer at the development nip can reach 23.2 wt % which is closer to an ideal density of the developer at the development nip in case where the developer in the developer container 31Y has an ideal density.

Described next will be a case that the monitor means detects that the density of the developer in the developer container 31Y has increased higher than the predetermined density. This case corresponds to the state of "High density" in Table 1. In this case, for example, when the monitor means detects that the density of the developer in the developer container 31Y is 23 wt %, control is carried out so as to decrease the quantity of carrier removed by the carrier quantity adjustment blade 23Y in contact with the toner compression roller 22Y and so as to decrease the rotation speed of the developer supply roller 32Y. Such control is performed to suppress changes in density of the developer at the development nip. More specifically, the developer supply roller linear speed is decreased to 183 mm/s, and the contact angle of the carrier quantity adjustment blade 23Y is set to 0° by the contact angle change mechanism. At this time, the carrier quantity adjustment blade 23Y is adjusted to bite into the toner compression roller 22Y by a biting amount of 0 mm, so that smaller quantity of carrier is removed. By such control, the density of the developer at the development nip can reach 23.4 wt % which is closer to the density of the developer at the development nip in case where the developer in the developer container 31Y has an ideal density.

In the embodiment as described above, the contact state of the carrier quantity adjustment blade 23Y provided for the toner compression roller 22Y is changed by the contact angle change mechanism, to adjust the quantity of carrier to be removed. Described next will be Example 2 in which the quantity of carrier to be removed is adjusted in correspondence with the type of paper by chancing pressure with which the carrier quantity adjustment blade 23Y provided for the toner compression roller 22Y is brought into contact with the toner compression roller 22Y.

Figure 8:
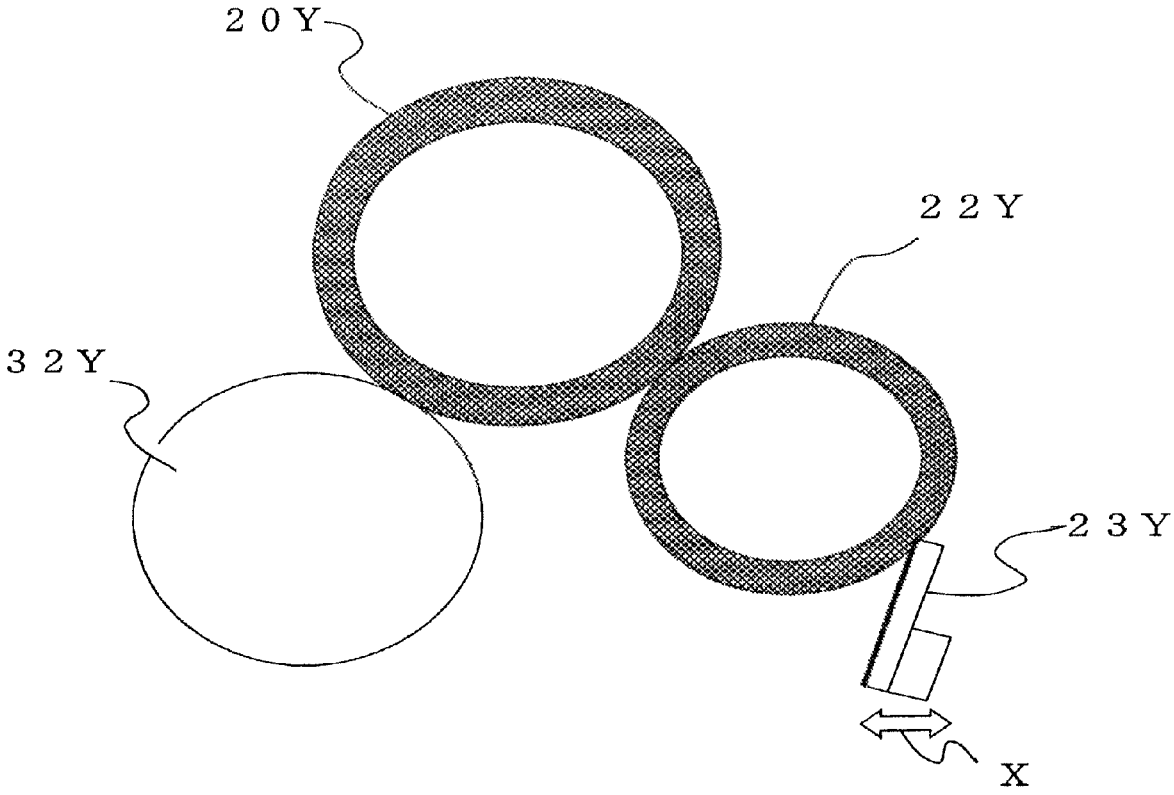
FIG. 8 shows a contact state of the carrier quantity adjustment blade 23Y in contact with the toner compression roller 22Y, and also shows the developing roller 20Y, and the developer supply roller 32Y.

FIG. 8 shows a contact state of the carrier quantity adjustment blade 23Y in contact with the toner compression roller 22Y, and also shows the developing roller 20Y, and the developer supply roller 32Y. In FIG. 8, X denotes a direction in which the carrier quantity adjustment blade 23Y is made movable relative to the toner compression roller 22Y. In this embodiment, a contact pressure change mechanism is provided. By this contact pressure change mechanism, the carrier quantity adjustment blade 23Y is moved close to or away from the toner compression roller 22Y in the X direction, so that the contact pressure of the carrier quantity adjustment blade 23Y is configured to be variable. This configuration characterizes this exemplary embodiment.

Table 2 shows developer supply roller linear speeds, carrier quantity adjustment blade contact pressures, carrier quantity adjustment blade biting amounts, and development nip densities where the contact pressure with which the carrier quantity adjustment blade 23Y makes contact with the toner compression roller 22Y is changed by the contact pressure change mechanism, in correspondence with densities inside a developer container which are detected by a monitor means, and where the rotation speed of the developer supply roller 32Y is changed. Definitions concerning the development nip are the same as described previously.

TABLE 2

| State | Density inside the developer container [wt %] | Developer supply roller linear speed [mm/s] | Carrier quantity adjustment blade contact pressure [gf/cm] | Carrier quantity adjustment blade biting amount [mm] | Density at the development nip [wt %] |
|---|---|---|---|---|---|
| Low density | 17 | 232 | 17 | 0.2 | 23.4 |
| Standard | 20 | 208 | 5 | 0.1 | 23.5 |
| High density | 22 | 190 | 3 | 0 | 23.6 |

If "Standard" applies to the column of "State" in Table 2, i.e., if the developer density inside the developer container 31Y is detected to be 20 wt % by the monitor means, an ideal developer density state is attained. At this time, control for normal image formation is carried out. That is, the developer supply roller linear speed is set to 208 mm/s, and the contact pressure of the carrier quantity adjustment blade 23Y is set to a standard 5 gf/cm by the contact pressure change mechanism. At this time, the carrier quantity adjustment blade 23Y is adjusted to bite into the toner compression roller 22Y by a biting amount of 0.1 mm. When such an ideal state is achieved concerning the density of the developer in the developer container 31Y, the density of the developer at the development nip is 23.5 wt %.

Described next will be a case that the monitor means detects that the density of the developer in the developer container 31Y has decreased lower than a predetermined density. This case corresponds to the state of "Low density" in Table 2. In this case, for example, when the monitor means detects that the density of the developer in the developer container 31Y is 17 wt %, control is carried out so as to increase the quantity of carrier removed by the carrier quantity adjustment blade 23Y in contact with the toner compression roller 22Y and so as to increase the rotation speed of the developer supply roller 32Y. Such control is performed to suppress changes in density of the developer at the development nip. More specifically, the developer supply roller linear speed is increased to 232 mm/s, and the contact pressure of the carrier quantity adjustment blade 23Y is set to 17 gf/cm by the contact angle change mechanism. At this time, the carrier quantity adjustment blade 23Y is adjusted to bite into the toner compression roller 22Y by a biting amount of 0.2 mm, so that greater quantity of carrier is removed. By such control, the density of the developer at the development nip can reach 23.4 wt % which is closer to an ideal density of the developer at the development nip in case where the developer in the developer container 31Y has an ideal density.

Described next will be a case that the monitor means detects that the density of the developer in the developer container 31Y has increased higher than the predetermined density. This case corresponds to the state of "High density" in Table 2. In this case, for example, when the monitor means detects that the density of the developer in the developer container 31Y is 22 wt %, control is carried out so as to decrease the quantity of carrier removed by the carrier quantity adjustment blade 23Y in contact with the toner compression roller 22Y and so as to decrease the rotation speed of the developer supply roller 32Y. Such control is performed to suppress changes in density of the developer at the development nip. More specifically, the developer supply roller linear speed is decreased to 190 mm/s, and the contact pressure of the carrier quantity adjustment blade 23Y is set to 3 gf/cm by the contact pressure change mechanism. At this time, the carrier quantity adjustment blade 23Y is adjusted to bite into the toner compression roller 22Y by a biting amount of 0 mm, so that smaller quantity of carrier is removed. By such control, the density of the developer at the development nip can reach 23.6 wt % which is closer to the ideal density of the developer at the development nip in case where the developer in the developer container 31Y has an ideal density.

In the second embodiment, the carrier quantity adjustment blade 23Y provided for the toner compression roller 22Y is used to change quantity of carrier, at the secondary transfer position, depending on paper types, such as paper having a smooth surface which hardly absorbs a carrier liquid or coated paper having a surface coated thick (coated with a large quantity of coating agent) rough paper having coarse texture like recycled paper which easily absorbs the carrier liquid, ordinary paper which absorbs the carrier liquid at an intermediate absorbent rate between the coated paper and rough paper, etc.

More specifically, if a paper type is determined by print setting through a personal computer, a cartridge in a printer body for stocking paper sheets, or a setting screen in a control panel section in the printer body, the quantity of carrier is adjusted by changing a contact state of the carrier quantity adjustment blade 23Y in contact with the toner compression roller 22Y so as to set a quantity of carrier in accordance with the paper type.

Figure 9:
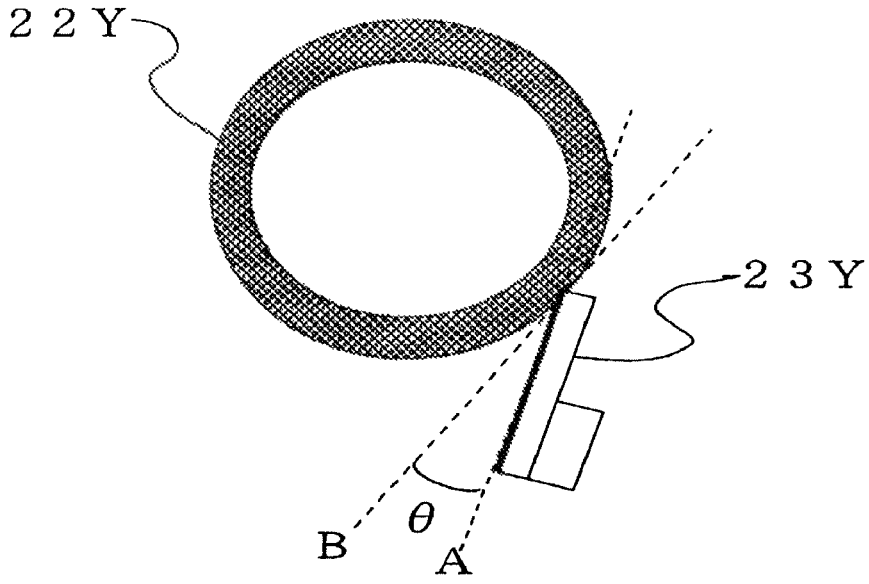
FIG. 9 shows a contact state of the carrier quantity adjustment blade 23Y in contact with the toner compression roller 22Y.

FIG. 9 shows a contact state of the carrier quantity adjustment blade 23Y in contact with the toner compression roller 22Y, taken from a different configuration. In FIG. 9, ? denotes an angle defined as a contact angle of the carrier quantity adjustment blade 23Y, i.e., an angle between an extension (A) of a not-curved part of the carrier quantity adjustment blade 23Y (non-contact part) and a tangent (B) which extends through a contact point between the carrier quantity adjustment blade 23Y and the toner compression roller 22Y. In Example 1 of this second embodiment, a contact angle change mechanism for the carrier quantity adjustment blade 23Y is provided to change the contact angle ?. This contact angle change mechanism is configured to be capable of changing a contact state between the toner compression roller 22Y and the carrier quantity adjustment blade 23Y at the same time when changing the contact angle. More specifically, the contact angle change mechanism can change conditions of the contact state, such as a contact point at which the carrier quantity adjustment blade 23Y makes contact with the toner compression roller 22Y, and a biting amount by which the carrier quantity adjustment blade 23Y bites into the roller 22Y. Further, the contact angle change mechanism has a mode for moving the carrier quantity adjustment blade 23Y away from the toner compression roller 22Y. Table 3 shows contact angles ?, contact states, biting amounts, quantities of carrier at the development nip, and solid content rates at the position of the development nip where the contact state in which the carrier quantity adjustment blade 23Y makes contact with the toner compression roller 22Y is changed by the contact angle change mechanism, in correspondence with paper types. The development nip refers to a nip created by the image carrier member 10Y and the developer roller 20Y contacting each other. The quantities of carrier shown in Table 3 are quantities of carrier at the developing nip, not quantities of carrier at the secondary transfer position. However, if quantity of carrier at the developing nip can be changed in correspondence with paper types, as shown in Table 3, the quantity of carrier can be changed in correspondence with a change in quantity of carrier at the development nip even at the secondary transfer position after undergoing process following the development nip. Process following development nip which can cause the quantity of carrier to change at the secondary transfer position includes squeeze process using the image carrier member squeeze roller 13Y, primary transfer process at the primary transfer unit for each of colors Y, M, C, and K, and squeeze process using the intermediate transfer member squeeze roller after the primary transfer process for each color. In this exemplary embodiment, however, only carrier quantity adjustment using the carrier quantity adjustment blade 23Y for the toner compression roller 22Y is carried out. This is because, as described in "SUMMARY", if adjustment of quantity of carrier depending on paper types is carried out in the process following the development nip, there is a possibility that a developed image causes disturbance.

TABLE 3

| Paper type | Contact angle ? | Contact state | Biting amount | Carrier quantity at the development nip | Solid content rate at the development nip |
|---|---|---|---|---|---|
| Coated paper | 10° | Contact at a blade edge | 0.2 mm | 54 | 27.0% |
| Ordinary paper | 0° | Contact at a blade face | 0.1 mm | 66 | 23.3% |
| Rough paper | 0° | No contact | — | 80 | 20.0% |

In Table 3, "Carrier quantity at the development nip" refers to quantity of carrier where the quantity of carrier in the developer in the developer container 31Y is assumed to be 80. Since the developer in the developer container 31Y has a toner solid content of 20 wt % and a carrier content of 80 wt %, the quantity of carrier in the developer in the developer container 31Y is thus defined to 80.

As shown in Table 3, depending on the paper types of "Coated paper", "Ordinary paper", and "Rough paper", the contact angle change mechanism changes the contact state, e.g., a contact point where the carrier quantity adjustment blade 23Y makes contact with the toner compression roller 22Y and a biting amount of the carrier quantity adjustment blade 23Y at the contact point.

When the type of paper to be printed is "Coated paper", the contact angle change mechanism sets the contact angle of the carrier quantity adjustment blade 23Y to 100 and puts an edge part of the carrier quantity adjustment blade 23Y into contact with the toner compression roller 22Y. At this time, the contact angle change mechanism adjusts the carrier quantity adjustment blade 23Y so as to bite into the toner compression roller 22Y by a biting amount of 0.2 mm. Then, the quantity of carrier at the development nip is 54, and the solid content rate at the development nip is 27.0%.

Alternatively, when the type of paper to be printed is "Ordinary paper", the contact angle change mechanism sets the contact angle of the carrier quantity adjustment blade 23Y to 0° and puts a face (or body) part of the carrier quantity adjustment blade 23Y into contact with the toner compression roller 22Y, wherein the face part is a flat part of the carrier quantity adjustment blade 23Y. At this time, the contact angle change mechanism adjusts the carrier quantity adjustment blade 23Y so as to bite into the toner compression roller 22Y by a biting amount of 0.1 mm. Then, the quantity of carrier at the development nip is 66, and the solid content rate at the development nip is 23.3%.

Alternatively, when the type of paper to be printed is "Rough paper", the contact angle change mechanism puts the carrier quantity adjustment blade 23Y away from the toner compression roller 22Y. Then, the quantity of carrier at the development nip is 54, and the solid content rate at the development nip is 27.0%.

As described above, in this embodiment, the contact state of the carrier quantity adjustment blade 23Y provided for the toner compression roller 22Y can be changed by the contact angle change mechanism, depending on paper types, such as paper having a smooth surface which hardly absorbs a carrier liquid or coated paper having a surface coated thick (coated with a large quantity of coating agent), rough paper having coarse texture like recycled paper which easily absorbs the carrier liquid, ordinary paper which absorbs the carrier liquid at an intermediate absorbent rate between the coated paper and rough paper, etc. Accordingly, the quantity of carrier is adjusted. As a result of this, secondary transfer can be carried out under optimal secondary transfer conditions depending on paper types without causing disturbance in images.

In the embodiment described above, the contact state of the carrier quantity adjustment blade 23Y provided for the toner compression roller 22Y is changed by the contact angle change mechanism, to change the quantity of carrier, depending on paper types. Described next will be Example 2 of the second embodiment in which the quantity of carrier is changed depending on paper types by chancing pressure with which the carrier quantity adjustment blade 23Y provided for the toner compression roller 22Y is brought into contact with the toner compression roller 22Y.

Figure 10:
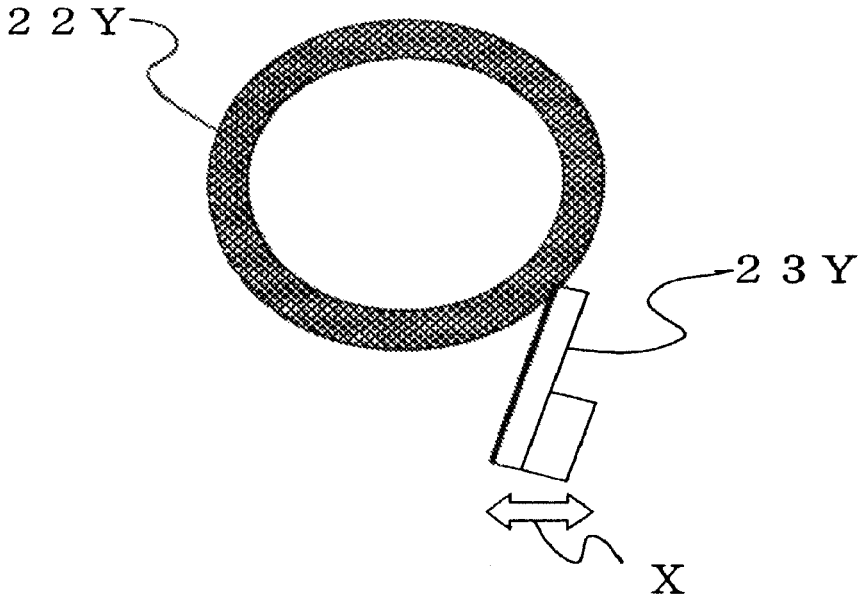
FIG. 10 shows a contact state of the carrier quantity adjustment blade 23Y in contact with the toner compression roller 22Y.

FIG. 10 shows a contact state of the carrier quantity adjustment blade 23Y in contact with the toner compression roller 22Y, taken from a different configuration. In FIG. 10, X denotes a direction in which the carrier quantity adjustment blade 23Y is made movable relative to the toner compression roller 22Y. In this embodiment, a contact pressure change mechanism is provided. By this contact pressure change mechanism, the carrier quantity adjustment blade 23Y is moved close to or away from the toner compression roller 22Y in the X direction, so that the contact pressure of the carrier quantity adjustment blade 23Y is configured to be variable. This configuration characterizes this exemplary embodiment.

Table 4 shows contact pressures, biting amounts, quantities of carrier at the development nip, and solid content rates at the position of the development nip where the contact pressure with which the carrier quantity adjustment blade 23Y makes contact with the toner compression roller 22Y is changed by the contact pressure change mechanism, depending on paper types. Definitions concerning the development nip and the "Carrier quantity at the development nip" are the same as those described previously.

TABLE 4

| Paper type | Blade contact pressure | Biting amount | Carrier quantity at the development nip | Solid content rate at the development nip |
|---|---|---|---|---|
| Coated paper | 18 gf/cm | 0.2 mm | 52 | 27.8% |
| Ordinary paper | 5 gf/cm | 0.1 mm | 65 | 23.5% |
| Rough paper | 0 gf/cm | — | 80 | 20.0% |

FIG. 4 shows quantities of the carrier at the development nip, which are not quantities of the carrier at the secondary transfer position. However, as shown in Table 4, if the quantity of carrier at the development nip can be changed in correspondence with paper types, the quantity of carrier can be considered to be further able to be changed even at the secondary transfer position after undergoing process following the development nip, in correspondence with changes in the quantity of carrier at the developing nip. Process following the development nip, which can cause the quantity of carrier to change at the secondary transfer position includes squeeze process using the image carrier member squeeze roller 13Y, primary transfer process at the primary transfer unit for each of colors Y, N, C, and K, and squeeze process using the intermediate transfer member squeeze roller after the primary transfer process for each color. In this exemplary embodiment, however, only carrier quantity adjustment using the carrier quantity adjustment blade 23Y for the toner compression roller 22Y is carried out. This is because, as described in "SUMMARY OF THE INVENTION", if adjustment of the quantity of carrier depending on paper types is carried out in any process following the development nip, there is a possibility that a developed image causes disturbance. This possibility is common to the embodiment described previously.

As shown in Table 4, depending on the paper types of "Coated paper", "Ordinary paper", and "Rough paper", the contact pressure change mechanism changes contact pressure with which the carrier quantity adjustment blade 23Y makes contact with the toner compression roller 22Y, and a biting amount of the carrier quantity adjustment blade 23Y changes depending on the changed contact pressure.

When the type of paper to be printed is "Coated paper", the contact pressure change mechanism sets the contact pressure of the carrier quantity adjustment blade 23Y to 18 fg/cm. At this time, the carrier quantity adjustment blade 23Y bites into the toner compression roller 22Y by a biting amount of 0.2 mm, the quantity of carrier at the development nip is 52, and the solid content rate at the development nip is 27.8%.

Alternatively, when the type of paper to be printed is "Ordinary paper", the contact pressure change mechanism sets the contact pressure of the carrier quantity adjustment blade 23Y to 5 fg/cm. At this time, the carrier quantity adjustment blade 23Y bites into the toner compression roller 22Y by a biting amount of 0.1 mm, the quantity of carrier at the development nip is 65, and the solid content rate at the development nip is 23.5%.

Alternatively, when the type of paper to be printed is "Rough paper", the contact pressure change mechanism sets the contact pressure of the carrier quantity adjustment blade 23Y to 0 fg/cm (i.e., the carrier quantity adjustment blade 23Y is put apart from the toner compression roller 22Y). At this time, the carrier quantity adjustment blade 23Y does not bite into the toner compression roller 22Y, the quantity of carrier at the development nip is 80, and the solid content rate at the development nip is 20.0%.

As described above, in this second embodiment, the contact pressure of the carrier quantity adjustment blade 23Y provided for the toner compression roller 22Y can be changed by the contact pressure change mechanism, depending on paper types, such as paper having a smooth surface which hardly absorbs a carrier liquid or coated paper having a surface coated thick (coated with a large quantity of coating agent), rough paper having coarse texture like recycled paper which easily absorbs the carrier liquid, ordinary paper which absorbs the carrier liquid at an intermediate absorbent rate between the coated paper and rough paper, etc. Accordingly, the quantity of carrier is adjusted. As a result of this, secondary transfer can be carried out under optimal secondary transfer conditions depending on paper types without causing disturbance in images.

In the exemplary embodiment described above, the contact state of the carrier quantity adjustment blade 23Y provided for the toner compression roller 22Y is changed by the contact angle change mechanism or the contact pressure of the carrier quantity adjustment blade 23Y is changed by the contact pressure change mechanism, to change the quantity of carrier, depending on paper types. In brief, according to the second embodiment of the present invention, the quantity of carrier at the secondary transfer position is adjusted depending on paper types, by adjusting the quantity of carrier on the toner compression roller 22Y. Therefore, this configuration can be arranged such that another carrier quantity adjustment means than the mechanisms described above can be provided above the toner compression roller 22Y. Such carrier quantity adjustment means will now be described below.

Figure 11:
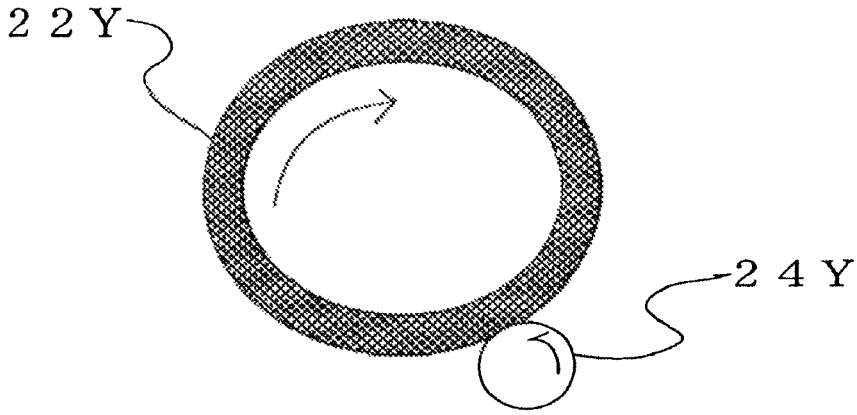
FIG. 11 shows a contact state of a carrier quantity adjustment roller 24Y in contact with the toner compression roller 22Y.

A carrier quantity adjustment means using a roller will now be described as Example 3 of the carrier quantity adjustment means. FIG. 11 shows a contact state of a carrier quantity adjustment roller 24Y in contact with the toner compression roller 22Y, taken from a different configuration. In this embodiment, a mechanism for changing a pressure with which the carrier quantity adjustment roller 24Y presses the toner compression roller 22Y is provided. A nip pressure between the carrier quantity adjustment roller 24Y and the toner compression roller 22Y is configured to be changeable. According to this configuration, for example, in case of coated paper, a stronger nip pressure is set so as not to allow a carrier oil to pass through the nip between rollers. In case of ordinary paper, a weaker nip pressure is set so as to allow a small quantity of carrier oil to pass. In case of rough paper, the carrier quantity adjustment roller 24Y is set apart from the toner compression roller 22Y so as to allow all carrier oil to pass.

Figure 12:
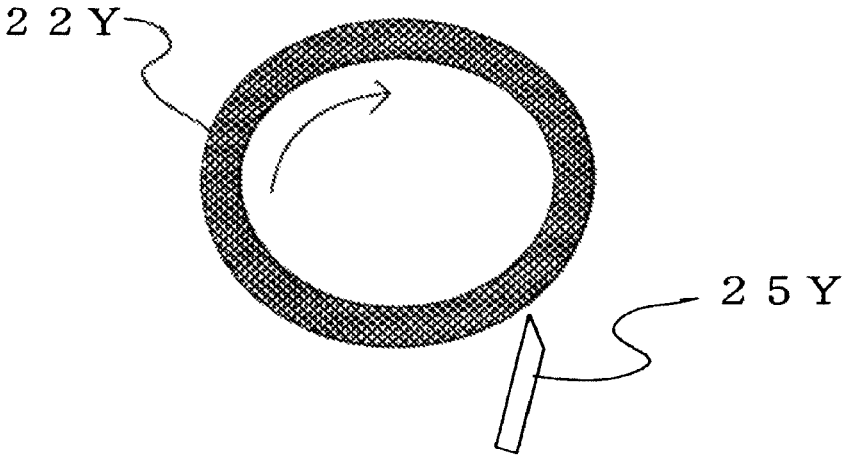
FIG. 12 shows location of a carrier quantity adjustment air knife 25Y relative to the toner compression roller 22Y.

A carrier quantity adjustment means using an air knife will now be described as Example 4 of the carrier quantity adjustment means. FIG. 12 shows location of a carrier quantity adjustment air knife 25Y relative to the toner compression roller 22Y, taken from a different configuration. This embodiment is characterized in that the carrier quantity adjustment air knife 25Y for injecting compressed air toward the toner compression roller 22Y is provided. More specifically, air is injected throughout the whole width in axis directions from a slit nozzle of the carrier quantity adjustment air knife 25Y. The quantity of carrier is adjusted by intensity of pressure of the air injection. For example, in case of coated paper, a stronger injection pressure is set so as to blow off all carrier oil (inhibit all carrier oil from passing through). In case of ordinary paper, a slightly weaker injection pressure is set so as to allow a small quantity of carrier oil to pass. In case of rough paper, air injection is not effected but all carrier oil is allowed to pass.

By the carrier quantity adjustment means as described above, optimal secondary transfer conditions can be obtained depending on paper types, such as paper having a smooth surface which hardly absorbs a carrier liquid or coated paper having a surface coated thick (coated with a large quantity of coating agent), rough paper having coarse texture like recycled paper which easily absorbs the carrier liquid, ordinary paper which absorbs the carrier liquid at an intermediate absorbent rate between the coated paper and rough paper, etc.

Next, a development system in an image forming apparatus according to the third embodiment will be described with reference to FIGS. 13 to 17. Described first will be a relationship between rotation speed of the bias application roller (compaction roller) 22Y as a toner compression roller and density of the developer on the developing roller 20Y, and a relationship between bias of the bias application roller 22Y and the density of the developer on the developing roller 20Y.

Figure 13:
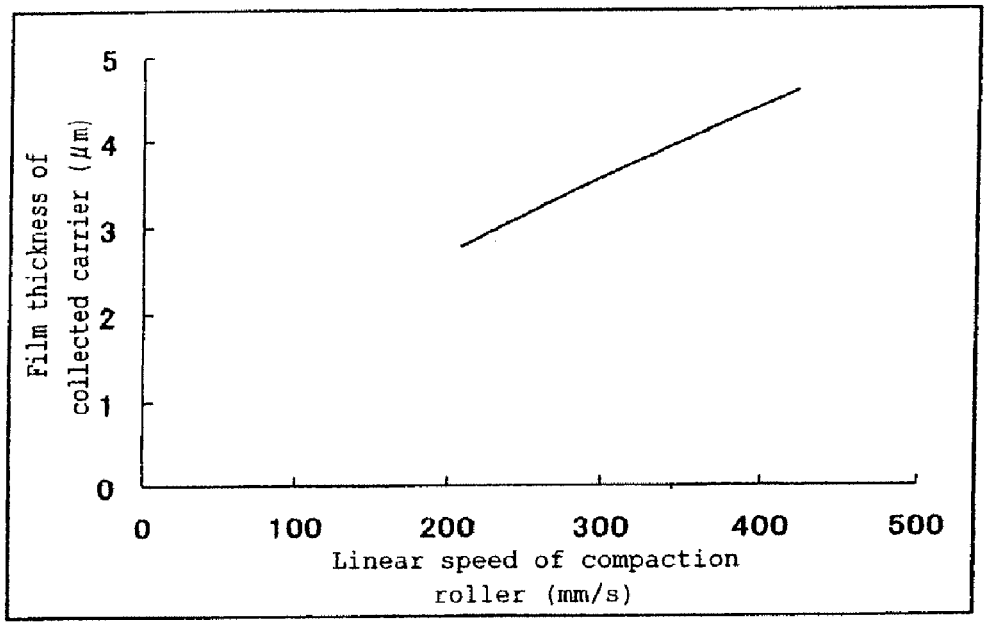
FIG. 13 shows a relationship between rotation speed of the bias application roller 22Y and a carrier C collected by the bias application roller 22Y.

FIG. 13 shows the relationship between the rotation speed of the bias application roller (compaction roller) 22Y and the carrier C collected by the bias application roller 22Y. A voltage applied by the bias application roller 22Y is +800 V. The horizontal axis in FIG. 13 represents a linear speed of the bias application roller 22Y, and the vertical axis represents a film thickness of the collected carrier C. The film thickness of the collected carrier C indicated along the vertical axis is converted to 210 mm/s equal to that of the developing roller 20Y, by multiplying the film thickness of the bias application roller 22Y by a linear speed of the bias application roller 22Y/a linear speed of the developing roller 20Y. As can be apparently seen from FIG. 13, when the linear speed of the bias application roller 22Y is approximately 200 mm/s, the film thickness of the collected carrier C is approximately 3 μm. When the linear speed of the bias application roller 22Y is approximately 400 mm/s, the film thickness of the collected carrier C is approximately 4.5 μm. Thus, the quantity of the collected carrier C increases at a substantially constant rate as the linear speed increases faster. That is, in order to raise the density of solid content in the developer on the developing roller 20Y, the film thickness of the collected carrier C needs only to be increased. Hence, the density of solid content can be raised by merely increasing the rotation speed of the bias application roller 22Y. Inversely, in order to lower the density of solid content in the developer on the developing roller 20Y, the film thickness of the collected carrier C needs only to be decreased. Hence, the density of solid content can be lowered by merely decreasing the rotation speed of the bias application roller 22Y.

Figure 14:
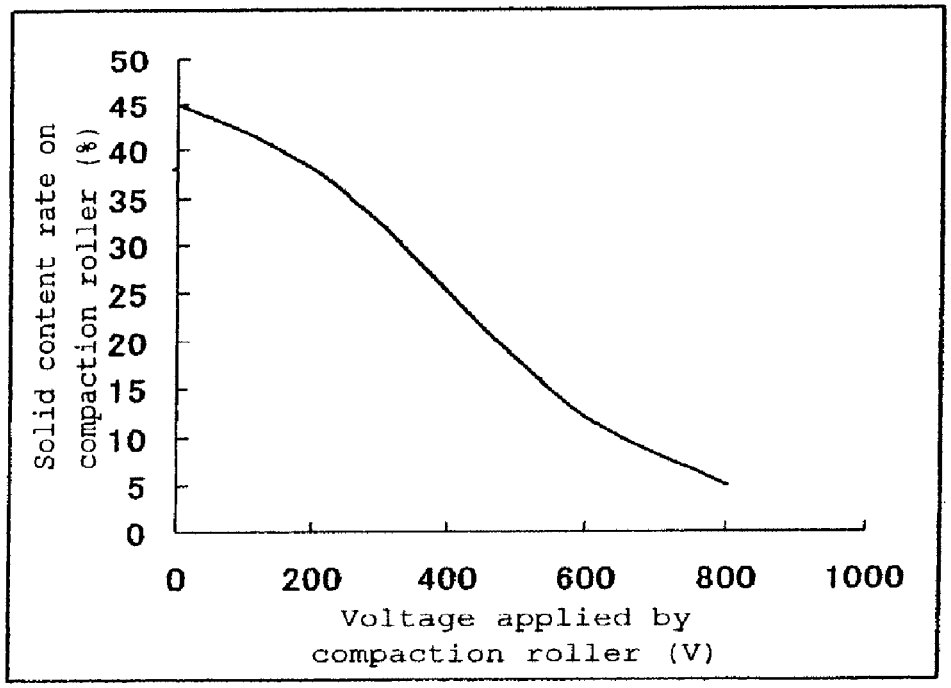
FIG. 14 shows a relationship between bias of the bias application roller 22Y and density of solid content in the carrier C collected by the bias application roller 22Y.

FIG. 14 shows the relationship between the bias of the bias application roller (compaction roller) 22Y and the density of solid content in the carrier C collected by the bias application roller 22Y. The horizontal axis in FIG. 14 represents the bias of the bias application roller 22Y, and the vertical axis represents the solid content rate on the bias application roller 22Y. As can be seen from FIG. 14, when the bias of the bias application roller 22Y is 0 V, the density of solid content in the carrier C on the bias application roller 22Y is approximately 45%. In contrast, when the bias of the bias application roller 22Y is +400 V, the density of solid content in the carrier C on the bias application roller 22Y is approximately 25%. When the bias of the bias application roller 22Y is +800 V, the density of solid content in the carrier C on the bias application roller 22Y is approximately 5%. Thus, the density of solid content in the carrier C on the bias application roller 22Y decreases at a substantially constant rate as the bias of the bias application roller 22Y increases. That is, a decrease in the density of solid content in the carrier C on the bias application roller 22Y means an increase in the density of solid content in the carrier C on the developing roller 20Y. In other words, the density of solid content in the developer on the developing roller 20Y rises as the bias of the bias application roller 22Y increases.

In this embodiment, the density of solid content in the developer is measured from a residual weight after all the carrier oil evaporates, according to TA instrument thermogravimetric analysis in an nitrogen atmosphere. The temperature rising speed is 20 K/min, and the temperature rising range is set to 50 to 404° C.

In this embodiment, the relationship between the rotation speed of the bias application roller 22Y and the density of the developer on the developing roller 20Y, and the relationship between the bias of the bias application roller 22Y and the density of the developer on the developing roller 20Y are thus utilized to adjust the linear speed of the developer supply roller 32Y, the contact angle or contact pressure of the regulation blade 33Y, and the rotation speed or bias of the bias application roller 22Y. In this manner, the density of the developer on the developing roller 20Y is adjusted maintaining the film thickness on the developing roller 20Y.

Figure 15:
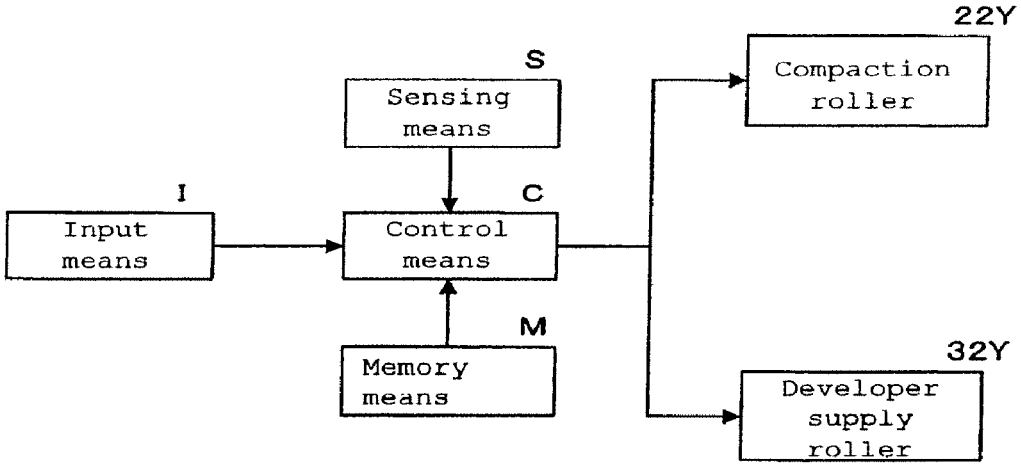
FIG. 15 is a block diagram of Example 1 according to the third embodiment.

FIG. 15 is a block diagram showing a development system according to Example 1 of the third embodiment. Reference symbols I, S, C, M, 22Y, and 32Y respectively denote an input means, sensing means, control means, memory means, a bias application roller (compaction roller), and a developer supply roller. At first, a target value of a density of developer is directly input or a type of a transfer material or the like is input by the input means I. Inputting is carried out via print setting from a PC, a cartridge where paper is contained, a setting screen on a control panel of a printer built in an image forming apparatus, or the like. For example, buttons, indications, or the like are prepared as parts forming the input means I which allows selection from coated paper, ordinary paper (e.g., J-paper manufactured by FUJI ZEROX), rough paper, and the like. When coated paper is selected by an operator, a density of approximately 45% is set. When ordinary paper is selected, approximately 55% is set. When rough paper (bond paper) or recycled paper is selected, approximately 60% is set. These values are for the secondary transfer position. Next, a density of the developer in the developer container 31Y is detected by the sensing means S. In this embodiment, rotation torque of the stirring roller 34Y in the developer container 31Y is detected, and a density of developer is obtained from data comparing rotation torque and densities of developer. Next, adjustment is performed on a liner speed of the developer supply roller 32Y and a linear speed or bias of the bias application roller 22Y each corresponding to a target value input by the input means I and stored in the memory means M or the density of the developer in the developer container 31Y obtained by the sensing means S. In this manner, the density of developer at the development nip and the density of developer at the secondary transfer position are adjusted.

Data stored in the memory means M is prepared by variously combining each of the target value input by the input means I or the density of developer in the developer container 31Y obtained by the sensing means S, or the target value input by the input means I or the density of developer in the developer container 31Y obtained by the sensing means S, with a corresponding linear speed of the developer supply roller 32Y and a corresponding rotation speed of the bias application roller 22Y or a bias of the bias application roller 22Y, or a corresponding linear speed of the developer supply roller 32Y and a corresponding rotation speed of the bias application roller 22Y or a corresponding bias of the bias application roller 22Y.

Table 5 shows a relationship between linear speed (rotation speed) of the ANILOX roller (developer supply roller) 32Y, linear speed of the bias application roller (compaction roller) 22Y, and bias of the bias application roller 22Y in case where the film thickness at the development nip is substantially constant and the density of developer is controlled to 30% when the density of developer in the developer container 31Y is approximately 25% and rough paper rougher than ordinary paper is input via the input means.

TABLE 5

| Paper type | ANILOX roller linear speed (mm/s) | Compaction roller linear speed (mm/s) | Compaction roller bias (V) | Film thickness on the developing roller (μm) | Density on the developing roller (%) |
|---|---|---|---|---|---|
| Ordinary paper | 210 | 220 | 700 | 3.50 | 25.0 |
| Rough paper | 250 | 270 | 700 | 3.53 | 30.0 |
| Rough paper | 250 | 220 | 770 | 3.50 | 29.8 |

In this embodiment, when ordinary paper is input as a reference value to the input means, setting is so arranged that the film thickness at the development nip is 3.50 μm and the density of developer at the development nip is 25.0% if the linear speed of the ANILOX roller 32Y is set to 210 m/s, the linear speed of the bias application roller 22Y is set to 220 mm/s, and the bias of the bias application roller 22Y is set to +700 V. When rough paper rougher than ordinary paper inputs via the input means, there is a case that the linear speed of the bias application roller 22Y is changed without changing the bias of the bias application roller 22Y from a reference value. In this case, if the linear speed of the ANILOX roller 32Y is set to 250 m/s, the linear speed of the bias application roller 22Y is set to 270 mm/s, and the bias of the bias application roller 22Y is set to +700 V, the film thickness at the development nip is 3.53 μm and the density of developer at the development nip is 30.0%. When the rough paper is input, there is another case that the bias of the bias application roller 22Y is changed without changing the linear speed of the bias application roller 22Y from a reference value. In this case, if the linear speed of the ANILOX roller 32Y is set to 250 m/s, the linear speed of the bias application roller 22Y is set to 220 mm/s, and the bias of the bias application roller 22Y is set to +770 V, the film thickness at the development nip is 3.50 μm and the density of developer at the development nip is 29.8%. Thus, the film thickness and the density of developer both at the development nip are substantially constant values.

Figure 16:
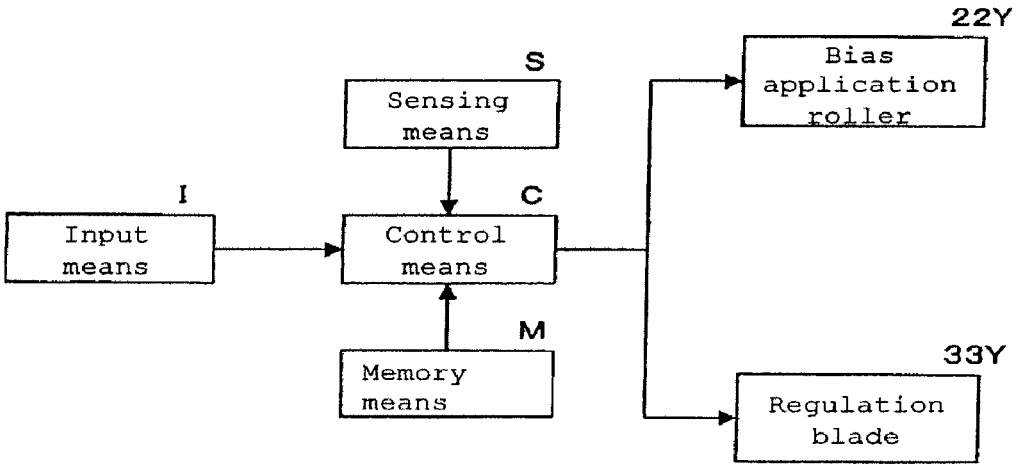
FIG. 16 is a block diagram of Example 2 according to the third embodiment.

FIG. 16 is a block diagram showing a development system according to Example 2 of the third embodiment. Reference symbols I, S, C, M, 22Y, and 33Y respectively denote an input means, sensing means, control means, memory means, bias application roller, and regulation blade. At first, a target value of a density of developer is directly input or a type of a transfer material or the like is input by the input means I. Inputting is carried out via print setting from a PC, a cartridge where paper is contained, a setting screen on a control panel of a printer built in an image forming apparatus, or the like. For example, buttons, indications, or the like are prepared as parts forming the input means I which allows selection from coated paper, ordinary paper (e.g., J-paper manufactured by FUJI ZEROX), rough paper, and the like. When coated paper is selected by an operator, a density of approximately 45% is set. When ordinary paper is selected, approximately 55% is set. When rough paper (bond paper) or recycled paper is selected, approximately 60% is set. These values are for the secondary transfer position. Next, a density of the developer in the developer container 31Y is detected by the sensing means S. In this embodiment, rotation torque of the stirring roller 34Y in the developer container 31Y is detected, and a density of developer is obtained from data comparing rotation torque with densities of developer. Next, adjustment is performed on a contact angle or contact pressure of the regulation blade 33Y and a linear speed (rotation speed) or bias of the bias application roller 22Y each corresponding to a target value input by the input means I and stored in the memory means M or the density of the developer in the developer container 31Y obtained by the sensing means S. In this manner, the density of developer at the development nip and the density of developer at the secondary transfer position are adjusted.

Data stored in the memory means M is prepared by variously combining each of the target value input by the input means I or the density of developer in the developer container 31Y obtained by the sensing means S, or the target value input by the input means I or the density of developer in the developer container 31Y obtained by the sensing means S, with a corresponding contact angle or contact pressure of the regulation blade 33Y and a corresponding rotation speed or bias of the bias application roller 22Y, or a corresponding contact angle or contact pressure of the regulation blade 33Y and a corresponding rotation speed or bias of the bias application roller 22Y.

Figure 17:
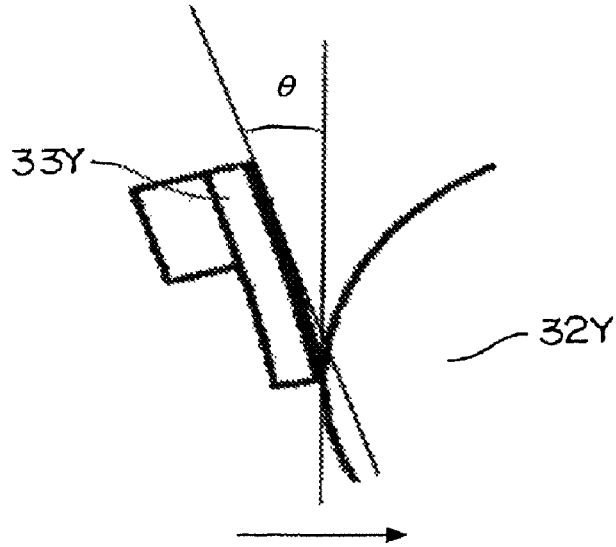
FIG. 17 shows a contact angle of a regulation blade 33Y.

FIG. 17 shows a contact angle of the regulation blade 33Y according to this embodiment. In this embodiment, the regulation blade 33Y is an elastic blade and bends when this blade 33Y is pressed against the developer supply roller 32Y. Hence, the contact angle is defined as an angle ? between an extension A of a not-bent part of the regulation blade 33Y and a tangent B penetrating through a contact point P at which the regulation blade 33Y touches the developer supply roller 32Y. In case of changing the contact angle ?, ? is increased without changing the position of the contact point P. In case of changing the contact pressure, the regulation blade 33Y is translated in parallel with a direction (an arrow direction in FIG. 17) vertical to the tangent B penetrating through the contact point P at which the regulation blade 33Y touches the developer supply roller 32Y.

Table 6 shows a relationship between contact angles of the regulation blade 33Y, linear speed of the bias application roller 22Y, and bias of the bias application roller 22Y in case where the film thickness at the development nip is substantially constant and the density of developer is controlled to 30% when the density of developer in the developer container 31Y is approximately 25% and rough paper rougher than ordinary paper is input via the input means.

TABLE 6

| Paper type | ANILOX roller regulation blade contact angle (°) | Bias application roller linear speed (mm/s) | Bias application roller bias (v) | Film thickness on the developing roller (μm) | Density on the developing roller (%) |
|---|---|---|---|---|---|
| Ordinary paper | 30 | 220 | 700 | 3.50 | 25.0 |
| Rough paper | 20 | 260 | 700 | 3.54 | 30.3 |
| Rough paper | 20 | 220 | 740 | 3.52 | 30.0 |

In this embodiment, when ordinary paper is input as a reference value to the input means, setting is so arranged that the film thickness at the development nip is 3.50 μm and the density of developer at the development nip is 25.0% if the contact angle of the regulation blade 33Y is set to 30°, the linear speed of the bias application roller 22Y is set to 220 mm/s, and the bias of the bias application roller 22Y is set to +700 V. When rough paper rougher than ordinary paper inputs via the input means, there is a case that the linear speed of the bias application roller 22Y is changed without changing the bias of the bias application roller 22Y from a reference value. In this case, if the contact angle of the regulation blade 33Y is set to 20°, the linear speed of the bias application roller 22Y is set to 260 mm/s, and the bias of the bias application roller 22Y is set to +700 V, the film thickness at the development nip is 3.54 μm and the density of developer at the development nip is 30.3%. Also when the rough paper is input, there is another case that the bias of the bias application roller 22Y is changed without changing the linear speed of the bias application roller 22Y from a reference value. In this case, if the contact angle of the regulation blade 33Y is set to 20°, the linear speed of the bias application roller 22Y is set to 220 mm/s, and the bias of the bias application roller 22Y is set to +740 V, the film thickness at the development nip is 3.52 μm and the density of developer at the development nip is 30.0%. Thus, the film thickness and the density of developer both at the development nip are substantially constant values.

Table 7 shows a relationship between contact pressure of the regulation blade 33Y, linear speed of the bias application roller 22Y, and bias of the bias application roller 22Y in case where the film thickness at the development nip is substantially constant and the density of developer is controlled to 30% when the density of developer in the developer container 31Y is approximately 25% and rough paper rougher than ordinary paper is input via the input means.

TABLE 7

| Paper type | ANILOX roller regulation blade contact pressure (gf/cm) | Bias application roller linear speed (mm/s) | Bias application roller bias (V) | Film thickness on the developing roller (μm) | Density on the developing roller (%) |
|---|---|---|---|---|---|
| Ordinary paper | 19 | 220 | 700 | 3.50 | 25.0 |
| Rough paper | 12 | 250 | 700 | 3.49 | 29.8 |
| Rough paper | 12 | 220 | 750 | 3.51 | 30.3 |

In this embodiment, when ordinary paper is input as a reference value to the input means, setting is so arranged that the film thickness at the development nip is 3.50 μm and the density of developer at the development nip is 25.0% if the contact pressure of the regulation blade 33Y is set to 19 gf/cm, the linear speed of the bias application roller 22Y is set to 220 mm/s, and the bias of the bias application roller 22Y is set to +700 V. When rough paper rougher than ordinary paper inputs via the input means, there is a case that the linear speed of the bias application roller 22Y is changed without changing the bias of the bias application roller 22Y from a reference value. In this case, if the contact pressure of the regulation blade 33Y is set to 12 gf/cm, the linear speed of the bias application roller 22Y is set to 250 mm/s, and the bias of the bias application roller 22Y is set to +700 V, the film thickness at the development nip is 3.49 μm and the density of developer at the development nip is 29.8%. Also when the rough paper is input, there is another case that the bias of the bias application roller 22Y is changed without changing the linear speed of the bias application roller 22Y from a reference value. In this case, if the contact pressure of the regulation blade 33Y is set to 12 gf/cm, the linear speed of the bias application roller 22Y is set to 220 mm/s, and the bias of the bias application roller 22Y is set to +750 V, the film thickness at the development nip is 3.51 μm and the density of developer at the development nip is 30.3%. Thus, the film thickness and the density of developer both at the development nip are substantially constant values.

Thus, by employing the development system according to this embodiment, the following effect can be attained. That is, if a target value or a type of paper is input, the linear speed of the developer supply roller 32Y, the contact angle or contact pressure of the regulation blade 33Y, and the rotation speed and bias of the bias application roller 22Y are adjusted so as to control approximately the density and film thickness of the developer at the development nip. Accordingly, excellent images having no unevenness can be formed with uniform density of developer.

What is claimed is:

1. A development system comprising:

a developer carrier member that carries a developer;

a developer supply roller that supplies the developer carrier member with the developer;

a developer container that stores the developer;

a toner compression roller that contacts with the developer carrier member and presses toner against the developer carrier member, the toner included in the developer;

input means for inputting a type of a recording medium; and density sensing means for sensing a density of the toner in the developer in the developer container, wherein a condition for the toner compression roller is changed depending on the density of the toner in the developer in the developer container or depending on the type of the recording medium, and depending on the type of the recording medium, a contact angle or contact pressure of a regulation blade for regulating a quantity of the developer to be supplied for the developer supply roller is changed, and a rotation speed and/or bias of the toner compression roller are changed.

2. The development system according to claim 1, wherein the toner compression roller is provided with carrier quantity adjustment means for changing a quantity of carrier to be removed.

3. The development system according to claim 2, wherein, when the density of the toner in the developer in the developer container is sensed to be lower than a desired value by the density sensing means, a rotation speed of the developer supply roller is increased and the quantity of carrier to be removed by the carrier quantity adjustment means is increased.

4. The development system according to claim 2, wherein when the density of the toner in the developer in the developer container is sensed to be higher than a desired value by the density sensing means, a rotation speed of the developer supply roller is decreased and the quantity of carrier to be removed by the carrier quantity adjustment means is decreased.

5. The development system according to claim 2, wherein the carrier quantity adjustment means is a blade capable of changing a state of contact that the blade makes with the toner compression roller.

6. The development system according to claim 2, wherein the carrier quantity adjustment means is a blade capable of changing a state of pressure with which the blade presses the toner compression roller.

7. The development system according to claim 2, wherein the carrier quantity adjustment means is an air knife that injects compressed air to the toner compression roller.

8. The development system according to claim 1, wherein depending on the type of the recording medium, a rotation speed of the developer supply roller is changed.

9. An image forming apparatus comprising:

an image carrier member;

a developer carrier member that carries a developer and develops a latent image on the image carrier member;

a developer container that stores the developer;

a developer supply roller that supplies the developer carrier member with the developer;

a toner compression roller that contacts with the developer carrier member and presses toner against the developer carrier member, the toner included in the developer;

a primary transfer unit that transfers the developed image formed on the image carrier member to the intermediate transfer member from the image carrier member;

a secondary transfer unit that further transfers the transferred image to a recording medium from the intermediate transfer member; and input means for inputting a type of a recording medium, wherein a condition for the toner compression roller is changed depending on the type of the recording medium.

10. An image forming method comprising:

supplying a developer from a developer container to a developer carrier member by a developer supply roller, the developer container storing the developer and the developer carrier member carrying the developer;

acquiring a type of a recording medium;

pressing toner included in the developer against the developer carrier member, with a condition changed depending on the type of the recording medium, by a toner compression roller that contacts with the developer carrier member;

developing a latent image formed on an image carrier member, by the developer carrier member, and transferring the developed image from the image carrier member to an intermediate transfer member, at a position of a primary transfer unit; and transferring further the transferred image from the intermediate transfer member to the recording medium, at a transfer position of a secondary transfer unit.

* * * * *